US008177319B2

(12) United States Patent
Nishihara

(10) Patent No.: US 8,177,319 B2
(45) Date of Patent: May 15, 2012

(54) LIQUID JETTING APPARATUS, LIQUID DELIVERY SYSTEM, AND CIRCUIT BOARD

(75) Inventor: Yuichi Nishihara, Suwa (JP)

(73) Assignee: Seiko Epson Corporation, Tokyo (JP)

( * ) Notice: Subject to any disclaimer, the term of this patent is extended or adjusted under 35 U.S.C. 154(b) by 495 days.

(21) Appl. No.: 12/424,375

(22) Filed: Apr. 15, 2009

(65) Prior Publication Data

US 2009/0262161 A1 Oct. 22, 2009

(30) Foreign Application Priority Data

Apr. 17, 2008 (JP) ..... 2008-108073
Apr. 9, 2009 (JP) ..... 2009-94710

(51) Int. Cl.
*B41J 2/175* (2006.01)
*B41J 2/195* (2006.01)
*B41J 29/393* (2006.01)

(52) U.S. Cl. ..... 347/19; 347/7; 347/86

(58) Field of Classification Search ..... 347/19, 347/7, 86
See application file for complete search history.

(56) References Cited

U.S. PATENT DOCUMENTS 6,447,090 B1 * 9/2002 Saruta ..... 347/19
6,729,184 B2 * 5/2004 Tsukada et al. ..... 347/7
2002/0112878 A1 8/2002 Ishizawa et al.

FOREIGN PATENT DOCUMENTS

| | | | |
|---|---|---|---|
| EP | 1 862 316 | A2 | 12/2009 |
| GB | 2424623 | | 10/2006 |
| JP | 03-284953 | A | 12/1991 |
| JP | 05-169673 | A | 7/1993 |
| JP | 08-156246 | A | 6/1996 |
| JP | 10-100447 | A | 4/1998 |
| JP | 2002-014870 | A | 1/2002 |
| JP | 2003-112431 | A | 4/2003 |
| JP | 2007-168078 | A | 7/2007 |
| JP | 2007-301975 | A | 11/2007 |
| JP | 2007-326298 | A | 12/2007 |

OTHER PUBLICATIONS

Extended European Search Report dated Jul. 27, 2009 in EU Pat. App. No. 09158070.4.

* cited by examiner

*Primary Examiner* — Julian Huffman
(74) *Attorney, Agent, or Firm* — Stroock & Stroock & Lavan LLP

(57) ABSTRACT

A liquid jetting apparatus receives delivery of liquid from a liquid delivery system including a delivery system-side terminal. The liquid jetting apparatus includes a apparatus-side terminal, a contact sensing portion and a remaining level sensor portion. The apparatus-side terminal contacts the delivery system-side terminal when receiving delivery of liquid from the liquid delivery system. The contact sensing portion supplies a first electrical signal to the apparatus-side terminal to sense contact between the apparatus-side terminal and the system-side terminal. The remaining level sensor portion supplies a second electrical signal different from the first electrical signal to the apparatus-side terminal to sense a liquid volume in the liquid delivery system.

10 Claims, 18 Drawing Sheets

Fig.17

| | S1 | S2 | S3 | S4 | S5 | S6 | S7 | S8 | OPERATION |
|---|---|---|---|---|---|---|---|---|---|
| LIQUID VOLUME SENSING PROCESS 1 | ON | OFF | OFF | ON | OFF | OFF | OFF | OFF | SUPPLY LIQUID VOLUME SENSE SIGNAL DS TO CONNECTION TERMINAL 430 |
| | OFF | OFF | OFF | ON | ON | OFF | OFF | OFF | RECEIVE LIQUID VOLUME RESPONSE SIGNAL RS FROM CONNECTION TERMINAL 430 |
| LIQUID VOLUME SENSING PROCESS 2 | ON | OFF | OFF | ON | OFF | OFF | OFF | OFF | SUPPLY LIQUID VOLUME SENSE SIGNAL DS TO CONNECTION TERMINAL 430 |
| | ON | OFF | OFF | OFF | OFF | ON | OFF | OFF | RECEIVE LIQUID VOLUME RESPONSE SIGNAL RS FROM CONNECTION TERMINAL 470 |
| LIQUID VOLUME SENSING PROCESS 3 | ON | OFF | OFF | ON | OFF | OFF | OFF | OFF | SUPPLY LIQUID VOLUME SENSE SIGNAL DS TO CONNECTION TERMINAL 430 |
| | OFF | OFF | OFF | OFF | ON | ON | OFF | OFF | RECEIVE LIQUID VOLUME RESPONSE SIGNAL RS FROM BOTH CONNECTION TERMINALS 430, 470 |
| LIQUID VOLUME SENSING PROCESS 4 | OFF | ON | ON | OFF | OFF | OFF | OFF | OFF | SUPPLY LIQUID VOLUME SENSE SIGNAL DS TO CONNECTION TERMINAL 470 |
| | OFF | ON | OFF | OFF | ON | OFF | OFF | OFF | RECEIVE LIQUID VOLUME RESPONSE SIGNAL RS FROM CONNECTION TERMINAL 430 |
| LIQUID VOLUME SENSING PROCESS 5 | OFF | ON | ON | OFF | OFF | OFF | OFF | OFF | SUPPLY LIQUID VOLUME SENSE SIGNAL DS TO CONNECTION TERMINAL 470 |
| | OFF | OFF | ON | OFF | OFF | ON | OFF | OFF | RECEIVE LIQUID VOLUME RESPONSE SIGNAL RS FROM CONNECTION TERMINAL 470 |
| LIQUID VOLUME SENSING PROCESS 6 | OFF | ON | ON | OFF | OFF | OFF | OFF | OFF | SUPPLY LIQUID VOLUME SENSE SIGNAL DS TO CONNECTION TERMINAL 470 |
| | OFF | OFF | OFF | OFF | ON | ON | OFF | OFF | RECEIVE LIQUID VOLUME RESPONSE SIGNAL RS FROM BOTH CONNECTION TERMINALS 430, 470 |
| CONTACT SENSING PROCESS | OFF | OFF | OFF | ON | OFF | OFF | ON | ON | JUST BEFORE SUPPLY CONTACT SENSE SIGNAL PS |
| | OFF | OFF | OFF | OFF | OFF | OFF | ON | ON | SUPPLY CONTACT SENSE SIGNAL PS |

LIQUID JETTING APPARATUS, LIQUID DELIVERY SYSTEM, AND CIRCUIT BOARD

CROSS REFERENCE TO RELATED APPLICATIONS

This application relates to and claims priority from Japanese Patent Application No. 2008-108073, filed on Apr. 17, 2008, and Japanese Patent Application No. 2009-94710, filed on Apr. 9, 2009, the entire disclosure of which is incorporated by reference.

BACKGROUND

1. Technical Field

The present invention relates to a liquid jetting apparatus, a liquid delivery system, and a circuit board.

2. Related Art

In liquid jetting apparatuses that employ an installed liquid container, for example a printer that employs an installed ink cartridge, detection of whether the ink cartridge is installed must be carried out in order to avoid situations where the printing process is executed with no ink cartridge installed. For example, by providing the printer with a apparatus-side sensor terminal adapted to detect whether an ink cartridge is installed and providing the ink cartridge with a container-side sensor terminal, detection of whether an ink cartridge is installed may be accomplished on the basis of changes in potential of the sensor terminal on the apparatus-side, depending on whether there is electrical continuity between the apparatus-side sensor terminal and the container-side sensor terminal (e.g. Patent Citation 1).

Meanwhile, in another known technology relating to a cartridge type head composed of an integrated inkjet recording head and ink tank and installable in a printer, detection of the remaining liquid level in the ink tank and detection of whether the cartridge type head has been installed in the printer are carried out on the basis of resistance across two electrodes (e.g. Patent Citation 2).

[Prior Art Citations] [Patent Citation 1] JP 2002-14870 A
[Patent Citation 2] JP 3-284953 A
[Patent Citation 3] JP 5-169673 A
[Patent Citation 4] JP 2003-39707 A However, with the technology disclosed in Patent Citation 1, it will be necessary to provide both the liquid container and the liquid jetting apparatus with dedicated sensor terminals for the purpose of detecting whether the liquid container is installed. It is moreover necessary to reduce the number of terminals on the liquid container, in order to avoid or reduce problems resulting from improper contact.

Meanwhile, with the technology disclosed in Patent Citation 2, there is a risk that considerable power consumption will be required in order to concomitantly carry out detection of remaining liquid level in the ink tank and detection of whether the cartridge type head has been installed in the printer.

The above problems are not limited to the combination of a liquid container with a liquid jetting apparatus, but are rather problems that can occur generally with devices designed to function with a removable component installed.

SUMMARY

Therefore, it is one object of the present invention to limit the increase in the number of terminals needing to be provided to the liquid container, and to limit power consumption of the liquid jetting apparatus.

A first aspect of the present invention provides a liquid jetting apparatus that receives delivery of liquid from a liquid delivery system including a delivery system-side terminal. The liquid jetting apparatus of the first aspect comprises an apparatus-side terminal, a contact sensing portion and a remaining level sensor portion. The apparatus-side terminal contacts the delivery system-side terminal when receiving delivery of liquid from the liquid delivery system. The contact sensing portion supplies a first electrical signal to the apparatus-side terminal to sense contact between the apparatus-side terminal and the system-side terminal. The remaining level sensor portion supplies a second electrical signal different from the first electrical signal to the apparatus-side terminal to sense a liquid volume in the liquid delivery system.

With this arrangement, the apparatus-side terminal is presented with a first electrical signal to sense contact between the apparatus-side terminal and the system-side terminal, while the apparatus-side terminal is presented with a second electrical signal different from the first electrical signal to sense the liquid volume in the liquid delivery system, thereby limiting the increase in the number of terminals.

In the liquid jetting apparatus pertaining to the first aspect, a power consumed to supply the first electrical signal may be less than a power consumed to supply the second electrical signal.

In this case, the power consumed when sensing contact between the apparatus-side terminal and the system-side terminal can be less than the power consumed when sensing the remaining level of liquid, so overall power consumption by the liquid jetting apparatus can be reduced.

In the liquid jetting apparatus pertaining to the first aspect, a frequency of execution of sensing the contact may be higher than a frequency of execution of sensing the liquid volume.

In this case, greater power consumption limiting effect will be afforded thereby.

In the liquid jetting apparatus pertaining to the first aspect, the first electrical signal may be a signal having a power supply voltage level of a digital controller that controls the liquid jetting apparatus, and the second electrical signal may be a signal that includes higher voltage than the power supply voltage level.

In this case, the voltage level of the electrical signal when sensing contact between the apparatus-side terminal and the system-side terminal will be equal to the power supply voltage level of the digital control signal, and thus power consumption by the liquid jetting apparatus can be reduced.

The liquid jetting apparatus pertaining to the first aspect may further comprises a liquid jetting portion that carries out jetting of the liquid responsive to a driving signal, and a driving signal generating circuit that generates the driving signal. The second electrical signal may be generated by the driving signal generating circuit, and the first electrical signal may be generated by a different circuit from the driving signal generating circuit.

In this case, contact between the apparatus-side terminal and the system-side terminal can be sensed even while the liquid jetting apparatus is being driven.

A second aspect of the present invention provides a liquid jetting apparatus including a liquid delivery system, the liquid jetting apparatus receiving delivery of liquid from the liquid delivery system. In the liquid jetting apparatus pertaining to the second aspect, the liquid delivery system comprises a first delivery system-side terminal, a second delivery system-side terminal and a capacitive element having first electrode and second electrode, the first electrode being connected to the first delivery system-side terminal, the second electrode being connected to the second delivery system-side terminal.

The liquid jetting apparatus pertaining to the second aspect comprises a first apparatus-side terminal, a second apparatus-side terminal and a contact sensing portion. The first apparatus-side terminal contacts the first delivery system-side terminal when receiving delivery of liquid from the liquid delivery system. The second apparatus-side terminal contacts the second delivery system-side terminal when receiving delivery of liquid from the liquid delivery system. The contact sensing portion supplies a first supplying electrical signal to the first apparatus-side terminal and that, when having received via the second apparatus-side terminal a first response electrical signal as a response to the first supplying electrical signal, decides that there is contact between the first apparatus-side terminal and the first delivery system-side terminal, and contact between the second apparatus-side terminal and the second delivery system-side terminal.

With this arrangement, contact of the delivery system-side terminal and the apparatus-side terminal can be sensed with low voltage, by supplying electrical signals to the capacitive element.

In the liquid jetting apparatus pertaining to the second aspect, the first supplying electrical signal may include a pulse signal having a rising edge and a falling edge. The first response electrical signal may include a signal having a waveform substantially identical to the pulse signal. The contact sensing portion, when having sensed a rising edge and a falling edge of the first response electrical signal, may decide that there is contact between the first apparatus-side terminal and the first delivery system-side terminal, and contact between the second apparatus-side terminal and the second delivery system-side terminal.

In this case, by sensing the rising edge and the falling edge, it is possible to improve the accuracy of sensing of contact between the first apparatus-side terminal and the first delivery system-side terminal, and between the second apparatus-side terminal and the second delivery system-side terminal.

In the liquid jetting apparatus pertaining to the second aspect, the contact sensing portion may supply a prescribed potential to the second apparatus-side terminal, and then may separate the second apparatus-side terminal from a prescribed potential, and then may supply the first supplying electrical signal to the first apparatus-side terminal.

In this case, since the first supplying electrical signal is supplied to the first apparatus-side terminal just after the second apparatus-side terminal has been presented with a prescribed potential and the potential of the second apparatus-side terminal has been stabilized, it will be possible to improve the accuracy of sensing of contact between the first apparatus-side terminal and the first delivery system-side terminal, and between the second apparatus-side terminal and the second delivery system-side terminal.

In the liquid jetting apparatus pertaining to the second aspect, the liquid delivery system may further comprise a device different from the capacitive element, and a third delivery system-side terminal connected to the device. The liquid jetting apparatus may further comprise a third apparatus-side terminal that contacts the third delivery system-side terminal when receiving delivery of liquid from the liquid delivery system. The third apparatus-side terminal may be arranged between the first apparatus-side terminal and the second apparatus-side terminal.

In this case, if contact between the first apparatus-side terminal and the first delivery system-side terminal, and contact between the second apparatus-side terminal and the second delivery system-side terminal can be sensed, it will be more highly probable that the third delivery system-side terminal and the third apparatus-side terminal are in contact as well. As a result, contact between the third delivery system-side terminal and the third apparatus-side terminal may be assured by sensing contact between the first apparatus-side terminal and the first delivery system-side terminal, and contact between the second apparatus-side terminal and the second delivery system-side terminal.

The liquid jetting apparatus pertaining to the second aspect may further comprise a liquid volume sensing portion that supplies a second supplying electrical signal different from the first supplying electrical signal to the first apparatus-side terminal, and that receives via the second apparatus-side terminal a second response electrical signal corresponding to the second electrical signal different from the first response signal to decide liquid volume in the liquid delivery system based on the second response electrical signal.

In this case, the second electrical signal different from the first electrical signal can be supplied to the same apparatus-side terminal, thereby limiting the increase in the number of terminals.

A third aspect of the present invention provides a liquid delivery system that delivers liquid to a liquid jetting apparatus having a first apparatus-side terminal, a second apparatus-side terminal and a third apparatus-side terminal. The liquid delivery system pertaining to the third aspect comprises an electrical device, a first delivery system-side terminal, a second delivery system-side terminal and a third delivery system-side terminal. The first delivery system-side terminal includes a first contact portion that contacts the first apparatus-side terminal when the liquid delivery system delivers the liquid to the liquid jetting apparatus. The second delivery system-side terminal includes a second contact portion that contacts the second apparatus-side terminal when the liquid delivery system delivers the liquid to the liquid jetting apparatus. The third delivery system-side terminal is connected to the electrical device and includes a third contact portion that contacts the third apparatus-side terminal when the liquid delivery system delivers the liquid to the liquid jetting apparatus. The third contact portion is arranged between the first contact portion and the second contact portion. The first delivery system-side terminal and the second delivery system-side terminal are used by the liquid jetting apparatus to check whether there is contact between the first apparatus-side terminal and the first delivery system-side terminal, and between the second apparatus-side terminal and the second delivery system-side terminal, and are used by the liquid jetting apparatus to check liquid volume in the liquid delivery system. In the check as to whether there is the contact, the first delivery system-side terminal receives a first supplying electrical signal from the liquid jetting apparatus via the first apparatus-side terminal. In the check of the liquid volume, the first delivery system-side terminal receives a second supplying electrical signal different from the first supplying electrical signal, from the liquid jetting apparatus via the first apparatus-side terminal.

In this arrangement, at the first delivery system-side terminal, a first supplying electrical signal is received and contact between the apparatus-side terminal and the system-side terminal is sensed; while at the same terminal, a second supplying electrical signal different from the first supplying electrical signal is received and the liquid volume in the liquid delivery system is sensed. Increases in the number of terminals can be reduced thereby.

In the liquid delivery system pertaining to the third aspect, in response to receipt of the first supplying electrical signal, a first response electrical signal may be output from the second delivery system-side terminal. In response to receipt of the second supplying electrical signal, a second response electrical signal different from the first response electrical signal may be output from at least one of the first delivery system-side terminal and the second delivery system-side terminal.

In this case, the liquid jetting apparatus can sense contact between a apparatus-side terminal and a system-side terminal by receiving a first response electrical signal, while also carrying out detection of the liquid volume in the liquid delivery system by receiving a second response electrical signal which is different from the first response electrical signal.

It is possible for the present invention to be embodied in various aspects, for example, a circuit board attachable to a liquid jetting apparatus when a liquid delivery system delivers liquid to the liquid jetting apparatus, a liquid jetting system that includes a liquid delivery system and a liquid jetting apparatus. Examples of other additional modes of the present invention are set forth below.

Another first mode of the present invention provides a liquid jetting apparatus that receives attachment of a liquid container. The liquid jetting apparatus according to this first mode comprises a liquid volume sensing terminal used for sensing liquid volume in the liquid container; and a sensing portion that senses, via the liquid volume sensing terminal, whether the liquid container is attached to the liquid jetting apparatus.

According to the liquid jetting apparatus of the above mode, presence of the attached liquid container can be sensed via the liquid volume sensing terminal that is used for sensing liquid volume in the liquid container, thus reducing the number of terminals needing to be provided to the liquid container.

In the liquid jetting apparatus according to the above mode, the sensing portion may output to the liquid volume sensing terminal an attachment check sense signal of lower voltage than a voltage of a liquid volume sense signal that is used for sensing the liquid volume. In this case, durability of the sensing portion can be improved.

In another possible arrangement of the liquid jetting apparatus according to the above mode, in the event that the signal sensed via the liquid volume sensing terminal has a signal characteristic observed at times that the liquid container is attached, the sensing portion senses that the liquid container is attached. This is because sensing of the signal characteristic observed at times that the liquid container is attached means that the liquid container is attached.

In yet another possible arrangement of the liquid jetting apparatus according to the above mode, the liquid container comprises a container sensing terminal adapted to connect to the liquid volume sensing terminal, and a liquid volume sensor connected to the container sensing terminal, and the signal characteristic observed at times that the liquid container is attached indicates an output characteristic of the liquid volume sensor in response to application of the attachment check sense signal. In this case, presence of an attached liquid container can be sensed via the liquid volume sensing terminal which is used for sensing liquid volume in the liquid container, thus reducing the number of terminals needing to be provided to the liquid container.

In yet another possible arrangement of the liquid jetting apparatus according to the above mode, the liquid container includes a container sensing terminal adapted to connect to the liquid volume sensing terminal, and a liquid volume sensor connected to the container sensing terminal, and the sensing portion outputs to the liquid volume sensing terminal a liquid volume sense signal for use in sensing liquid volume in the liquid container, and senses whether an attached liquid container is present, and additionally senses the liquid volume in the liquid container on the basis of a sense result signal that has been input to the liquid volume sensing terminal from the liquid volume sensor in response to the liquid volume sense signal. In this case, the liquid volume sense signal can be used to sense whether an attached liquid container is present.

In yet another possible arrangement of the liquid jetting apparatus according to the above mode, the sensing portion may output to the liquid volume sensing terminal an attachment check sense signal of lower voltage than a voltage of the liquid volume sense signal, to sense whether an attached liquid container is present. In this case, durability of the sensing portion can be improved.

In yet another possible arrangement of the liquid jetting apparatus according to the above mode, the liquid volume sensor includes a piezoelectric element sensor.

In yet another possible arrangement of the liquid jetting apparatus according to the above mode, in the event that characteristics of a signal sensed via the liquid volume sensing terminal do not match characteristics of the sense result signal, the sensing portion senses that the liquid container is not currently attached.

In yet another possible arrangement of the liquid jetting apparatus according to the above mode, a process of sensing presence of an attached liquid container may take place repeatedly. In this case, it will be possible for attachment or detachment of the liquid container to be sensed promptly.

The present invention in another second mode provides an attachment check method relating to a liquid container in a liquid jetting apparatus to which the liquid container is attachable. The attachment check method according to this second mode comprises sensing presence of an attached liquid container via a liquid volume sensing terminal that is used for sensing liquid volume in the liquid container.

With the attachment check method according to the above mode, presence of an attached liquid container can be sensed via the liquid volume sensing terminal that is used for sensing liquid volume in the liquid container, thus reducing the number of terminals needing to be provided to the liquid container. Like the first mode described earlier, the above mode can be embodied in various modes. The above mode may also be embodied as a computer program, or as a computer program recorded onto a computer-readable medium such as a CD, DVD, or HDD.

The present invention in another third mode provides a liquid jetting system that includes a liquid jetting apparatus and a liquid container attachable to the liquid jetting apparatus. In the liquid jetting system according to the third mode, the liquid jetting apparatus comprises a liquid container attachment portion adapted to receive attachment of the liquid container, a liquid volume sensing terminal disposed in the liquid container attachment portion and used for sensing liquid volume in the liquid container, and a sensing portion that senses, via the liquid volume sensing terminal, whether an attached liquid container is present; and the liquid container comprises a container sensing terminal that contacts the liquid volume sensing terminal when the liquid container is attached to the liquid container attachment portion, and a liquid volume sensor connected to the liquid volume sensing terminal.

With the liquid jetting system according to the above mode, presence of an attached liquid container can be sensed via the liquid volume sensing terminal used for sensing liquid volume in the liquid container, thus reducing the number of terminals needing to be provided to the liquid container.

The above and other objects, characterizing features, aspects and advantages of the present invention will be clear from the description of preferred embodiments presented below along with the attached figures.

BRIEF DESCRIPTION OF THE DRAWINGS

FIG. 17 is a table summarizing operation of switches S1 to S8 in a liquid volume sensing process and in a contact sensing process;

DETAILED DESCRIPTION OF THE PREFERRED EMBODIMENTS

A. First Embodiment

Figure 1:
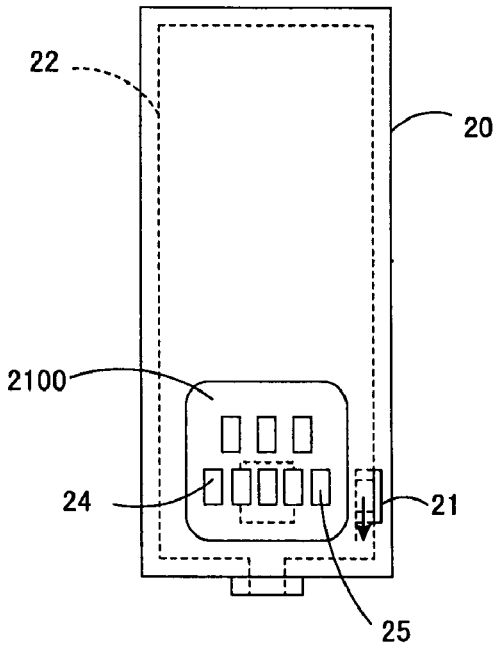
FIG. 1 is an illustration depicting an ink cartridge as an example of a liquid container in First embodiment.
Figure 2:
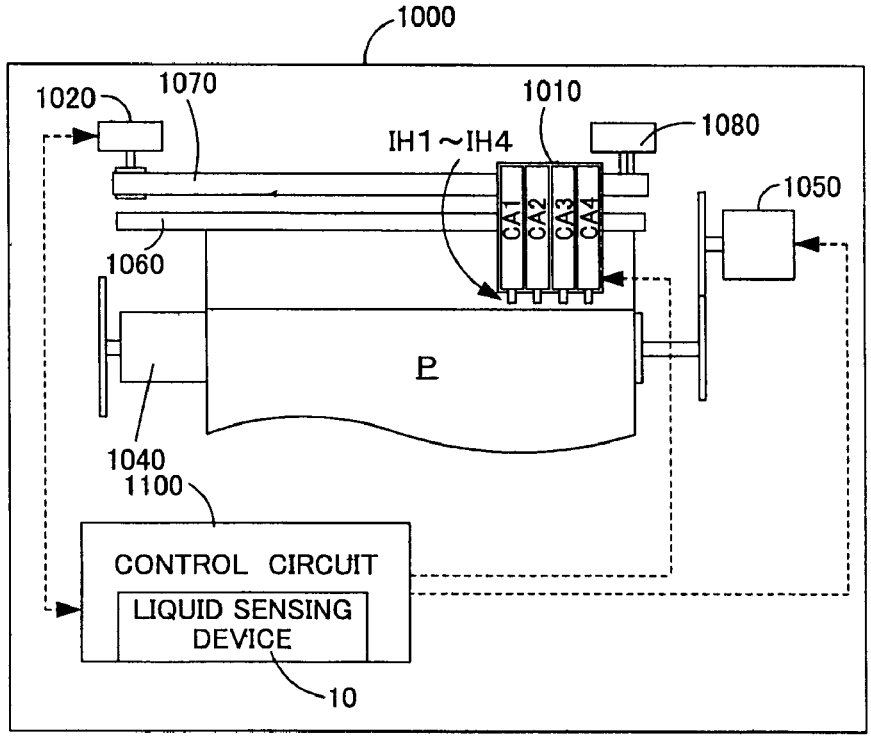
FIG. 2 is an illustration depicting a printing device as an example of a liquid jetting apparatus according to First embodiment.

FIG. 1 is an illustration depicting a liquid container according to First embodiment. FIG. 2 is an illustration depicting an example of a liquid jetting apparatus in First embodiment. In the present embodiment, a printing device 1000 is provided as the liquid jetting apparatus, and an ink cartridge 20 is provided as the liquid container. Also, the ink cartridge 20 may be provided with a storage device 2100 that is writable by the printing device 1000 and used to store information relating to the ink contained in the container. A general description of the configuration follows below, with detailed descriptions of constituent elements to come later.

As shown in FIG. 1, the ink cartridge 20 is furnished at a minimum with a container-side driving terminal 24 that is connected to a liquid sensing portion 21, and a container-side ground terminal 25. Where the storage device 2100 has been provided, information relating to a sense signal that is unique to a piezoelectric element 21*c* in the liquid sensing portion 21 may be stored in the storage device 2100. In this case, it would be possible to use a sense signal having appropriate frequency waveform for each individual piezoelectric element 21; since residual vibration waveforms having sufficient amplitude can be sensed, fluid volume sensing accuracy can be improved.

As depicted in FIG. 2, the printing device 1000 includes a control circuit 1100 and a printing section. The printing section includes a mechanism for driving print heads IH1 to IH4 that have been installed on a carriage 1010, in order to eject ink and produce dots; a mechanism for reciprocating motion of the carriage 1010 in the axial direction of a platen 1040 by a carriage motor 1020; and a mechanism for feeding printing paper P by a paper feed motor 1050. The mechanism for reciprocating motion of the carriage 1010 in the axial direction of the platen 1040 is composed of a slide rail 1060 extending parallel to the axis of the platen 1040 and adapted to slidably retain the carriage 1010; a pulley 1080 having an endless drive belt 1070 stretched between it and the carriage motor 1020; and a position sensor (not shown) for sensing the home position of the carriage 1010. The mechanism for feeding printing paper P is composed of the platen 1040; the paper feed motor 1050 which turns the platen 1040; paper feed assist rollers (not shown); and a gear train (not shown) adapted to transmit rotation of the paper feed motor 1050 to the platen 1040 and to the paper feed assist rollers.

The carriage 1010 also functions as an installation portion for receiving installation of the ink cartridge 20 (in the following discussion, symbols CA1 to CA4 will be used). The ink cartridge CA1 contains black (K) ink, the ink cartridge CA2 contains cyan (C) ink, the ink cartridge CA3 contains magenta (M) ink, and the ink cartridge CA4 contains yellow (Y) ink. It would be acceptable to additionally provide ink cartridges CA for light cyan (LC) ink, light magenta (LM) ink, dark yellow (DY) ink, light blue (LB) ink, red (R) ink, or blue (B) ink.

The carriage 1010 includes an external terminal group that includes the aforementioned apparatus-side driving terminal 14 and apparatus-side ground terminal 15; and through contact with the container-side driving terminal 24 and the container-side ground terminal 25 provided to the ink cartridges CA, the control circuit 1100 can apply a driving signal to the liquid sensing portion 21 to obtain a sense signal.

The control circuit 1100 includes a computation circuit and a storage device, not shown, and is adapted to control operation of the printing section and execute printing processes on the basis of received print data. The control circuit 1100 includes a liquid sensing device 10 that, based on an instruction from the control circuit 1100, will execute a liquid sensing process and an ink cartridge attachment check process, to be discussed later.

Configuration of Liquid Sensing Device and Ink Cartridge

Figure 3:
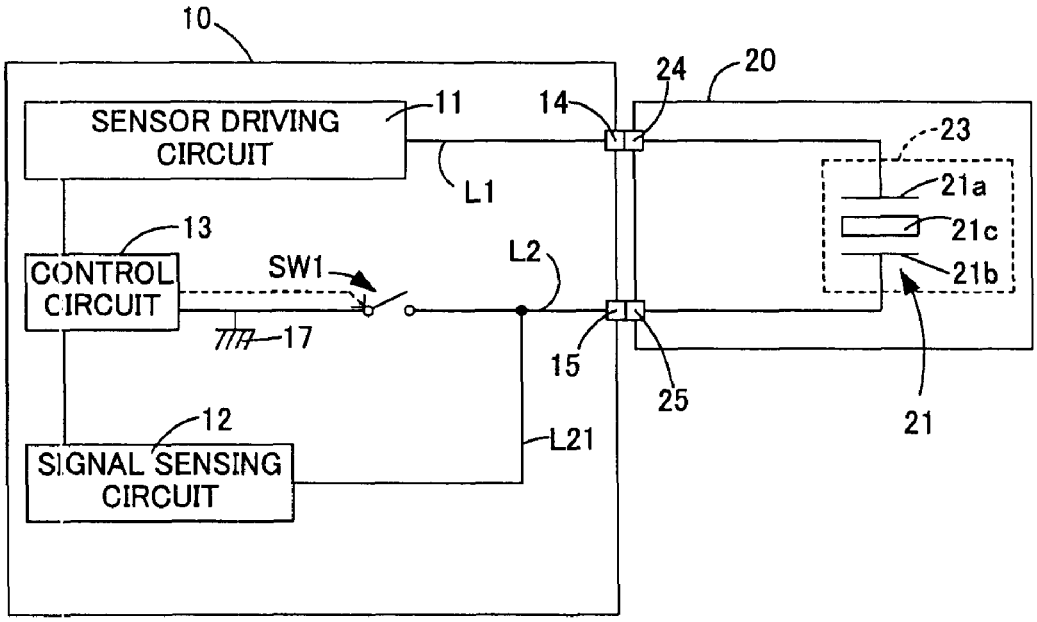
FIG. 3 is a block diagram showing the functional internal configuration of an ink cartridge and a liquid sensing device provided to the printing device according to First embodiment.
Figure 4:
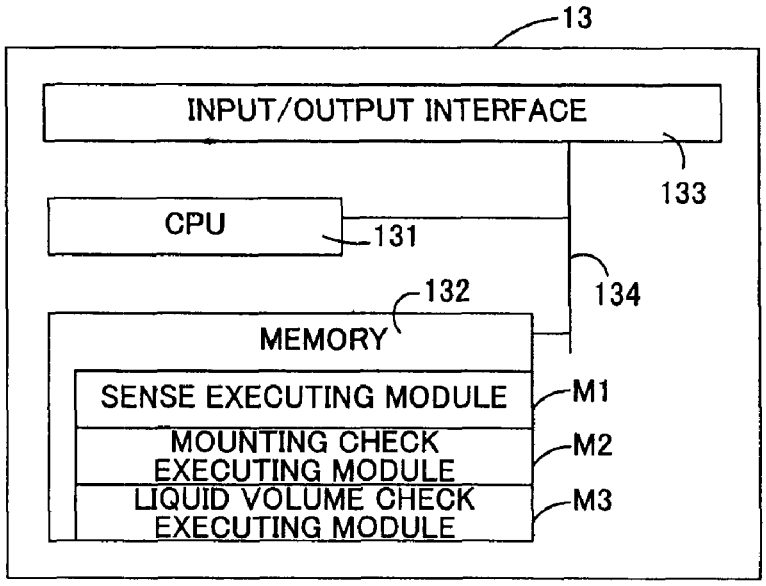
FIG. 4 is a block diagram showing the functional internal configuration of a control circuit provided to a liquid sensing device in First embodiment.

FIG. 3 is a block diagram showing the functional internal configuration of an ink cartridge and liquid sensing device provided to the printing device according to First embodiment. FIG. 4 is a block diagram showing the functional internal configuration of a control circuit provided to a liquid sensing device in First embodiment.

The liquid sensing device 10 in the present embodiment includes a sensor driving circuit 11, a signal sensing circuit 12, a control circuit 13, a switch SW1, the apparatus-side driving terminal 14, and the apparatus-side ground terminal 15. The ink cartridge 20 includes the liquid sensing portion 21, a liquid holding chamber 23, the container-side driving terminal 24, and the container-side ground terminal 25. In the present embodiment, as noted previously, the ink cartridge 20 is constituted as a separate unit from the printing device 1000, with the ink cartridge 20 being detachably installable on the printing device 1000. The liquid sensing device 10 and the ink cartridge 20 are electrically connected through the apparatus-side driving terminal 14 and the container-side driving terminal 24, and through the apparatus-side ground terminal 15 and the container-side ground terminal 25, respectively.

Configuration of Liquid Container

To facilitate the description, the description turns first to the configuration of the ink cartridge 20. The liquid sensing portion 21 is adapted to sense whether liquid in an amount equal to or greater than a prescribed amount is present in the liquid holding chamber 23, i.e. whether liquid is present in the liquid holding chamber 23. The liquid sensing portion 21 employed in the present embodiment uses as the liquid volume sensor a piezoelectric element 21*c* which is sandwiched by a first electrode 21*a* and a second electrode 21*b*. However, the liquid sensing portion 21 is not limited to one using a piezoelectric element 21, and there could be employed as the sensor some other electrical-mechanical energy converting element; or an element capable of outputting information relating to liquid volume, in the form of an electrical signal. For example, there could be employed a sensor having two electrodes positioned so as to come into direct contact with the liquid depending on the liquid volume, and designed to output different electrical signals when the liquid has come into contact with the two electrodes (i.e. where there is electrical continuity) versus when the liquid is not in contact with the two electrodes (i.e. where there is no electrical continuity due to the absence of intervening liquid between the electrodes). In this case, liquid volume can be checked based on the potential difference observed when there is electrical continuity and when there is electrical discontinuity.

The first electrode 21*a* of the liquid sensing portion 21 is connected to the container-side driving terminal 24, and the second electrode 21*b* is connected to the container-side ground terminal 25. When voltage is applied to the piezoelectric element 21*c* via the container-side driving terminal 24 and the first electrode 24, the piezoelectric element 21*c* to which the voltage has been applied will experience distortion due to the inverse piezoelectric effect. In this state, if a driving signal of prescribed frequency is applied to the piezoelectric element 21*c*, and voltage ceases to be applied to the container-side driving terminal 24 or the container-side ground terminal 25, the piezoelectric element 21*c* will experience free oscillation at the characteristic frequency (resonance frequency) of the system that includes the liquid sensing portion 21. The piezoelectric element 21*c* will experience residual oscillation at the characteristic frequency (resonance frequency) of the system that includes the liquid sensing portion 21, giving rise to back electromotive force through residual oscillation and outputting a back electromotive force signal (sense result signal) having residual oscillation frequency (residual oscillation waveform) that depends on fluctuations in the back electromotive force. Of the container-side driving terminal 24 and the container-side ground terminal 25, the sense result signal will be output the terminal to which application of voltage has ceased.

Here, since the system that includes the liquid sensing portion 21 also includes the liquid holding chamber 23, i.e. it contains a liquid, the characteristic frequency will differ depending on whether liquid is present. Consequently, it will be possible to check whether liquid is present in the system that includes the liquid sensing portion 21, on the basis of the sense result signal output by the liquid sensing portion 21 when a frequency signal corresponding to resonance frequency in the event that liquid is present in the system that includes the liquid sensing portion 21, or when a frequency signal corresponding to resonance frequency the event that liquid is absent in the system that includes the liquid sensing portion 21, is applied to the liquid sensing portion 21. Alternatively, there could be employed a common sense signal that affords a sense result signal, both in the event that liquid is present in the ink cartridge 20 and in the event that it is not. Where such a common sense signal is employed, using a single signal it will be possible to sense both cases where that liquid is present in the liquid sensing portion 21, and case where it is not.

Specific Check Methods:

(1) In the event that separate sense signals are employed, using as the input frequency signal a frequency signal that lies within the resonance frequency range assumable by the system that includes the liquid sensing portion 21 in the event that liquid is present or in the event that liquid is absent, if there has been successfully obtained a sense result signal that lies within the resonance frequency range assumable by the system that includes the liquid sensing portion 21, it can accordingly be checked whether liquid is present in the system that includes the liquid sensing portion 21. Here, the reason for using a resonance frequency range assumable by the system that includes the liquid sensing portion 21 is that the particular resonance frequency of the system that includes the liquid sensing portion 21 may vary due to factors such as errors in component accuracy.

(2) Where a common sense signal is employed, depending on whether the sense result signal obtained as a result of inputting a sense signal lies within a 'liquid present' frequency range observed when liquid is present in the system that includes the liquid sensing portion 21, or within a 'liquid absent' frequency range observed when liquid is absent in the system that includes the liquid sensing portion 21, it can be checked whether liquid is present in the system that include, the liquid sensing portion 21.

Configuration of Liquid Sensing Device

The apparatus-side driving terminal 14 is connected to the sensor driving circuit 11 via a first signal line L1. A ground portion 17 is connected to the apparatus-side ground terminal 15 via a second signal line L2. A switch SW1 for electrically connecting or disconnecting the ground portion 17 and the apparatus-side ground terminal 15 is situated on the second signal line L2. As the switch SW1 it would be possible to employ various types of transistors, as well as switching circuits of various kinds.

The sensor driving circuit 11 applies a driving signal (sense signal) having prescribed driving voltage and driving waveform to the liquid sensing portion 21 which has been provided to the ink cartridge 20. The sense signal is generated in a manner such as the following, for example. Driving waveform data of predetermined frequency has been stored in the sensor driving circuit 11, and the sensor driving circuit 11 will load the driving waveform data, and after carrying out digital-analog conversion, will execute integral treatment to generate a sense signal of prescribed voltage having a prescribed driving waveform. That is, the sense signal is a driving signal of prescribed voltage having a prescribed number of driving waveforms. The sensor driving circuit 11 will drive the liquid sensing portion 21 using an oscillation frequency that corresponds to the characteristic frequency observed in the event that sufficient liquid remains in the liquid holding chamber 23 of the ink cartridge 20, i.e. in the event that liquid is present in the system that includes the liquid sensing portion 21; or using a driving waveform that matches the characteristic frequency observed in the event that less than a prescribed amount of liquid remains in the liquid holding chamber 23 of the ink cartridge 20, i.e. where liquid is not present in the system that includes the liquid sensing portion 21.

The signal sensing circuit 12 is connected to the apparatus-side ground terminal 15 via the second signal line L2 and a third signal line L3. When the switch SW1 goes Off, the sense result signal which has been input to the apparatus-side ground terminal 15 will be input to the signal sensing circuit 12. Using the input sense result signal, the signal sensing circuit 12 will sense (check) whether liquid is present in the ink cartridge 20. More specifically, by measuring oscillation frequency based on the residual vibration waveform contained in the sense result signal, it will sense (check) whether liquid is present in the ink cartridge 20. As noted previously, the oscillation frequency of the sense result signal represents the characteristic frequency of structures (the housing and the liquid) situated around the liquid sensing portion 21 and which oscillate in tandem with the liquid sensing portion 21; and will vary depending on the volume of liquid remaining in the liquid containing chamber 23. Consequently, it will be possible to check whether an amount of liquid equal to or greater than a prescribed volume is remaining in the liquid containing chamber 23, on the basis of whether or not there is successful measurement of a sense result signal having an oscillation frequency of prescribed range that includes the oscillation frequency used for sensing, or of a sense result signal having an oscillation frequency that has been associated beforehand with the oscillation frequency used for sensing, from the liquid sensing portion 21 which has been driven using the sense signal discussed above.

The sensor driving circuit 11, the signal sensing circuit 12, and the switch SW1 are connected to the control circuit 13 via control signal lines. As depicted in FIG. 4, the control circuit 13 includes a central processing unit (CPU) 131 for carrying out computations; a memory 132 for storing computation results, a liquid sensing process execution program, and the like; and an input/output interface 133 for electrically connecting the CPU 131 and the memory 132, external circuits (the sensor driving circuit 11 and signal sensing circuit 12), and the switch SW1. The CPU 131, the memory 132, and the input/output interface 134 are interconnected by a bus 134.

In the memory 132 there are stored a sense executing module M1, a mounting check executing module M2, and a liquid volume check executing module M3. The following functions are accomplished through execution of the modules M1 to M3 by the CPU 131. The sense executing module M1 requests the sensor driving circuit 11 for output of a sense signal, and turns the switch SW1 On. The mounting check executing module M2 requests the signal sensing circuit 12 for a check as to the presence of input of a sense result signal of prescribed waveform, as well as turning the switch SW1 Off at timing coincident with termination of input of the driving waveform of the sense signal to the liquid sensing portion 21, thereby electrically disconnecting the ground portion 17 and the liquid sensing portion 21 (the second electrode 21*b*). The liquid volume check executing module M3 requests the signal sensing circuit 12 to check if liquid is present, as well as turning the switch SW1 Off at timing coincident with termination of input of the driving waveform of the sense signal to the liquid sensing portion 21, thereby electrically disconnecting the ground portion 17 and the liquid sensing portion 21 (the second electrode 21*b*).

A brief description of operation of the liquid sensing device 10 will now be provided. When the switch SW1 goes On, the sense executing module M1, through the agency of the sensor driving circuit 11, will apply to the first electrode 21*a* of the liquid sensing portion 21 an initial sense signal having a prescribed driving waveform associated with it. Once input of the driving waveform to the first electrode 21*a* has been completed, the liquid volume check executing module M3 will turn the switch SW1 to Off. At this time, the potential of the first electrode 21*a* of the liquid sensing portion 21 will be maintained it the sense signal voltage. By turning the switch SW1 to Off, the second electrode 21*b* of the liquid sensing portion 21 will output a sense result signal having a residual vibration waveform associated with it, and the sense result signal will be sensed by the signal sensing circuit 12.

On the basis of the sense result signal output from the liquid sensing portion 21 and sensed by the signal sensing circuit 12, the liquid volume check executing module M3 will check whether a prescribed amount or more of liquid is present in the ink cartridge 20.

Figure 5:
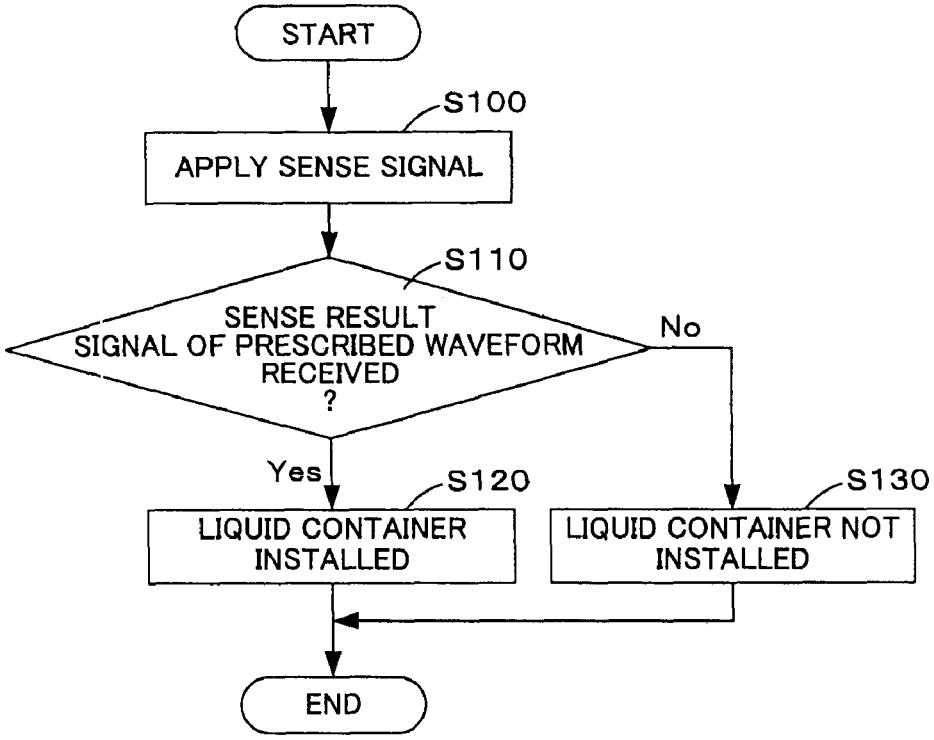
FIG. 5 is a flowchart of a processing routine for execution during an ink cartridge attachment check process in the printing device according to First embodiment.
Figure 6:
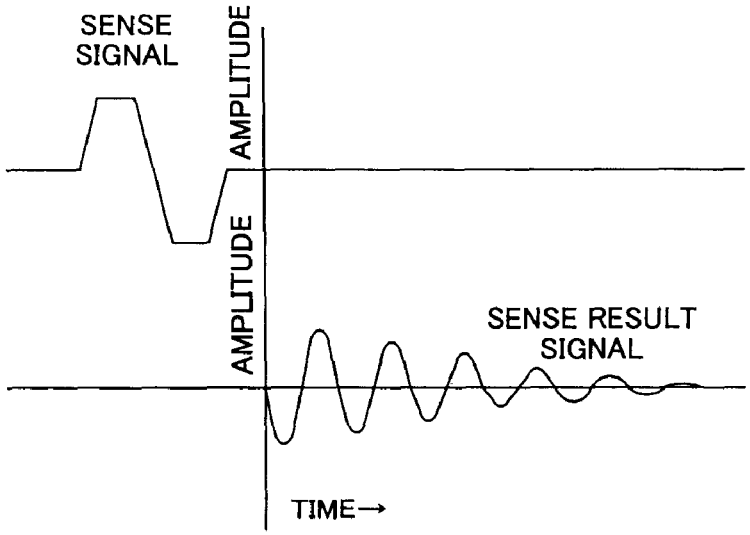
FIG. 6 is an illustration depicting an example of a sense result signal used in the attachment check process.

Ink Cartridge Attachment Check:

FIG. 5 is a flowchart of a processing routine for execution during an ink cartridge attachment check process in the printing device according to First embodiment FIG. 6 is an illustration depicting an example of a sense result signal used in the attachment check process.

The CPU 131 will repeatedly execute this attachment check process at prescribed timing. For example, the CPU 131 may execute the attachment check process at prescribed time intervals, when triggered by power-on of the printing device 1000. Alternatively, it may execute the attachment check process at variable time intervals according to operation of the printing device 1000. When the printing device 1000 is powered on, an additional liquid volume check process or (if the ink cartridge 20 has been provided with a storage device) a process to read out information stored in the storage device may be executed as well. If a liquid volume check process is executed, the liquid volume check process and the attachment check process may be executed in tandem.

When the processing routine is initiated, the CPU 131 will execute the sense executing module M1 and output a sense signal to the apparatus-side driving terminal 14 (Step S100). The CPU 131 will then execute the attachment check executing module M2, and after outputting a sense signal, will check whether it has received a sense result signal of prescribed waveform within a prescribed time period (Step S110). Specifically, it will either check whether the signal per se has been received by the signal sensing circuit 12, or whether the sense result signal that was received by the signal sensing circuit 12 is an appropriate sense result signal like that depicted in FIG. 6. If the ink cartridge 20 has not been installed in the installation portion, the apparatus-side ground terminal 15 will not receive input of the signal per se, i.e. of the sense result signal per se, or will receive input of a signal that is caused by extraneous noise, and will fail to receive input of an appropriate sense result signal. Here, an appropriate sense result signal refers to one like that depicted in FIG. 6, namely a sense result signal whose output has an expected waveform (frequency) in accordance with the sense signal (liquid volume sense signal); and more specifically refers to a sense result signal whose output has an expected waveform (frequency in a prescribed range) in accordance with the liquid volume sense signal and the volume of liquid in the ink cartridge 20.

In FIG. 6, the horizontal axis indicates time and the vertical axis indicates signal amplitude (voltage change); the top half depicts signal change observed at the first electrode 21*a* (the apparatus-side driving terminal 14, the container-side driving terminal 24), while the lower half depicts signal change observed at the second electrode 21*b* (the apparatus-side ground terminal 15, the container-side ground terminal 25). During the interval labeled 'sense signal' a sense signal having prescribed rectangular waveform will be input to the first electrode 21*a* and the second electrode 21*b* will be grounded to the ground portion 17. During the interval labeled 'sense result signal', initiated by the second electrode 21*b* being disconnected from the ground portion 17, a sense signal voltage lacking a rectangular waveform will be applied continuously to the first electrode 21*a* and a signal with a residual vibration waveform will appear as the sense result signal at the second electrode 21*b*. By determining whether the oscillation frequency of the sense result signal matches an oscillation frequency lying within an oscillation frequency range that has been predetermined with reference to liquid volume, it will be decided whether the signal is an appropriate sense result signal. In FIG. 6, to simplify the description, the description is based on a mode in which no return voltage arises.

In the event that the CPU 131 has successfully received a sense result signal of prescribed waveform (Step S110: YES), it will decide that the ink cartridge 20 has in fact been installed in the installation portion (Step S120), and will terminate the processing routine. The CPU 131 will then receive confirmation of installation of the ink cartridge 20, and will proceed to execute a subsequent process, for example, a liquid jetting process. In the present embodiment because the liquid jetting apparatus is a printing device 1000, a printing process that employs the liquid (ink) held in the ink cartridge 20, or a flushing process for cleaning the nozzles of the print head, may be carried out for example.

In the event that the CPU 131 cannot successfully receive a sense result signal of prescribed waveform (Step S110: NO), it will decide that an ink cartridge has not been installed in the installation portion (Step S130), and will terminate the processing routine. Where a liquid volume check process is carried out, this processing routine may be carried out as a subroutine of the liquid volume check process. This is specifically because in the processing routine, the attachment check is made on the basis of whether a sense result signal is input (received) in response to a liquid volume sense signal, so the sense result signal obtained from the ink cartridge 20 can be utilized both in the liquid volume check process and in the attachment check process.

Because this attachment check method can employ the sense signal that is used for sensing liquid volume, it will be possible for the liquid volume check process and the attachment check process to be carried out concomitantly, so the time required for the attachment check process can be reduced. Additionally the attachment check process can be carried out using the existing liquid sensing device 10.

Figure 7:
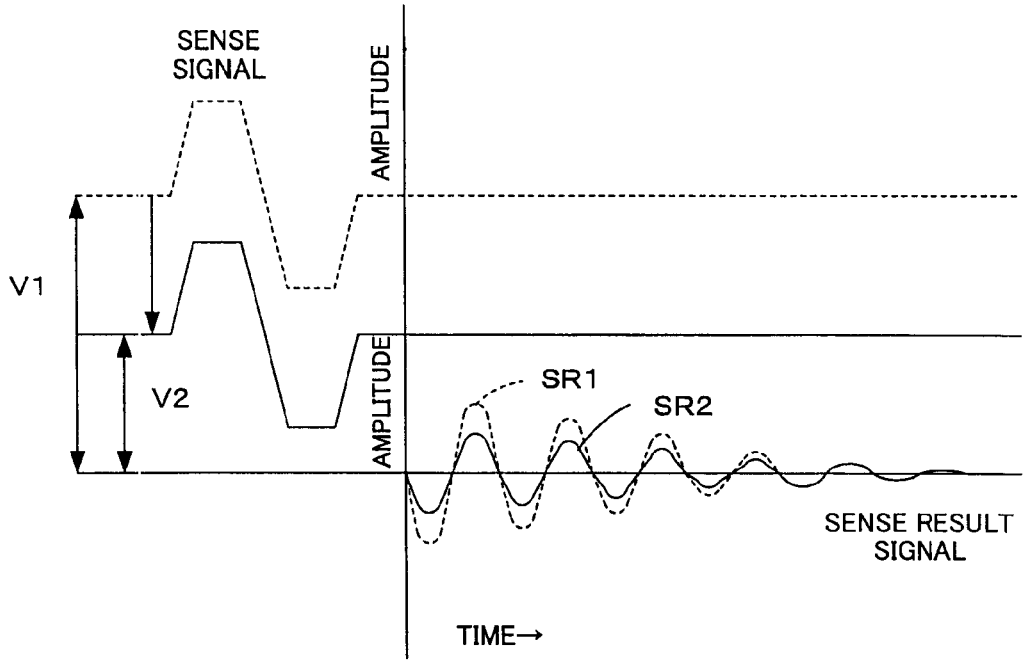
FIG. 7 is an illustration depicting an example of an attachment check process that uses a sense signal of lower voltage than the sense signal used for determining liquid volume.

Alternative Attachment Check Methods:

(1) In the preceding example, checking for the presence of an installed ink cartridge employs a sense signal of identical voltage to the sense signal employed to check liquid volume; however, it would be acceptable to carry out an attachment check using a sense signal of lower voltage than the liquid volume sense signal. FIG. 7 is an illustration depicting an example of an attachment check process that uses a sense signal of lower voltage than the sense signal used for determining liquid volume. In this example, the voltage of the liquid volume check sense signal is V1, whereas the voltage of the sense signal employed for the attachment check is V2, which is lower than V1. That is, the sense signal employed for the attachment check will have the same signal waveform as the liquid volume check sense signal, except that its voltage is V2. In this instance, the attachment check executing module M2 will request the sense executing module M1 to output a liquid volume check sense signal of voltage V2, and through the agency of the sensor driving circuit 11 will output a sense signal for use in the attachment check to the apparatus-side driving terminal 14.

The amplitude SR2 of the sense result signal obtained from the ink cartridge 20 will be smaller than the amplitude of the sense result signal SR1 when a sense signal of voltage V1 is employed; however, as the degree of accuracy required in the attachment check process is not as high as the degree of accuracy required in the liquid volume check process, this will suffice for the purpose of determining whether the ink cartridge 20 has been installed. Moreover, by employing lower voltage for the sense signal during the attachment check, the product life of the liquid sensing portion 21 can be prolonged. In particular, because the attachment check process is executed with much higher frequency than the liquid volume check process, there are noteworthy advantages to employing lower voltage for the sense signal. The attachment check process employing a signal of voltage V2 may be carried out at all times including startup of the printing device 1000, or at all times except for startup of the printing device 1000. In the latter instance, concomitant execution with the liquid volume check process will be possible as mentioned previously, so processing time can be made shorter.

Figure 8:
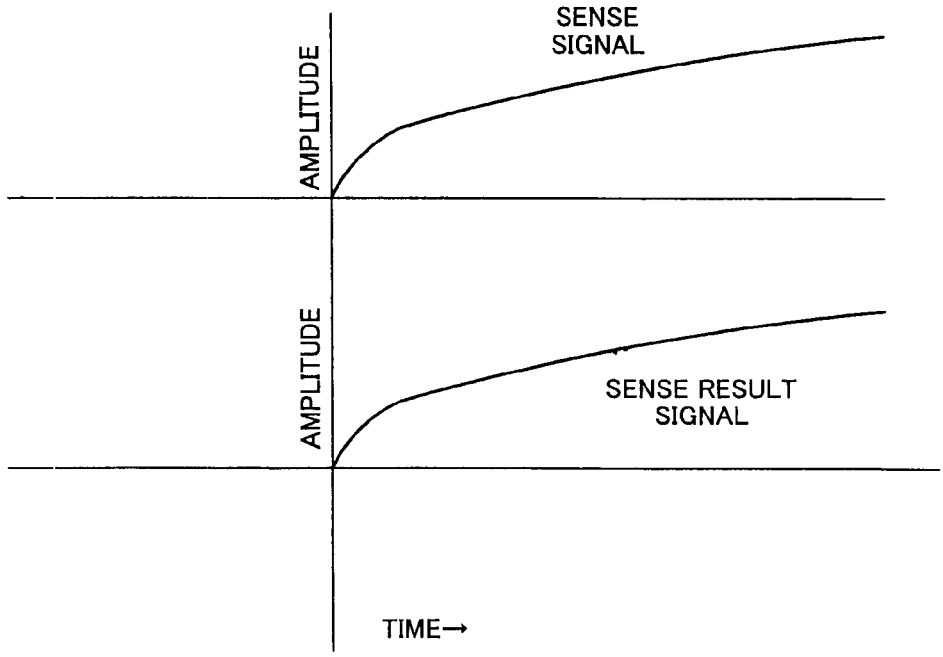
FIG. 8 is an illustration depicting a first example of an attachment check process using an attachment check sense signal.

(2) In the preceding two examples, checking for the presence of an installed ink cartridge in the installation portion of the printing device 1000 is carried out using the liquid volume check sense signal (i.e. a sense signal having prescribed waveform) could also be accomplished using an attachment check sense signal that differs from the liquid volume check sense signal. In this case, checking for the presence of the installed ink cartridge 20 can be accomplished by ascertaining whether the sense result signal has a signal characteristic that is observed when an ink cartridge is installed, for example, an characteristic observed in a signal that is output from the liquid sensing portion 21 in association with behavior of the liquid sensing portion 21 in response to input of the attachment check sense signal. FIG. 8 is an illustration depicting a first example of an attachment check process using an attachment check sense signal. The attachment check sense signal may have lower voltage or higher voltage than the liquid volume sense signal. Where an attachment check sense signal of lower voltage is employed, durability of the liquid sensing portion 21 can be improved.

In the first example depicted in FIG. 8, the voltage of the sense signal that is output from the apparatus-side driving terminal 14 is varied, and the presence of the installed ink cartridge 20 is checked based on whether the voltage of the sense result signal that is input to the apparatus-side ground terminal 15 changes in association with this voltage change of the sense signal. Specifically, the CPU 131 executes the attachment check executing module M2, turns the switch SW1 to On, outputs a sense signal from the sensor driving circuit 11 to the apparatus-side driving terminal 14, and varies the voltage over time.

If the ink cartridge 20 is installed, the liquid sensing portion 21 (the piezoelectric element 21*c*) will act as a capacitive component, and thus the voltage of the sense result signal that appears at the apparatus-side ground terminal 15 will vary according to voltage variation of the sense signal that is being output to the apparatus-side driving terminal 14. In the example of FIG. 8, the voltage of the sense result signal increases in association with increasing voltage of the sense signal. Consequently, if variation in accordance with variation of the sense signal appears in the sense result signal via the signal sensing circuit 12, the CPU 131 can determine that the ink cartridge 20 is installed in the installation portion; whereas if variation in accordance with variation of the sense signal does not appear in the sense result signal, it can determine that the ink cartridge 20 is not installed in the installation portion.

Figure 9:
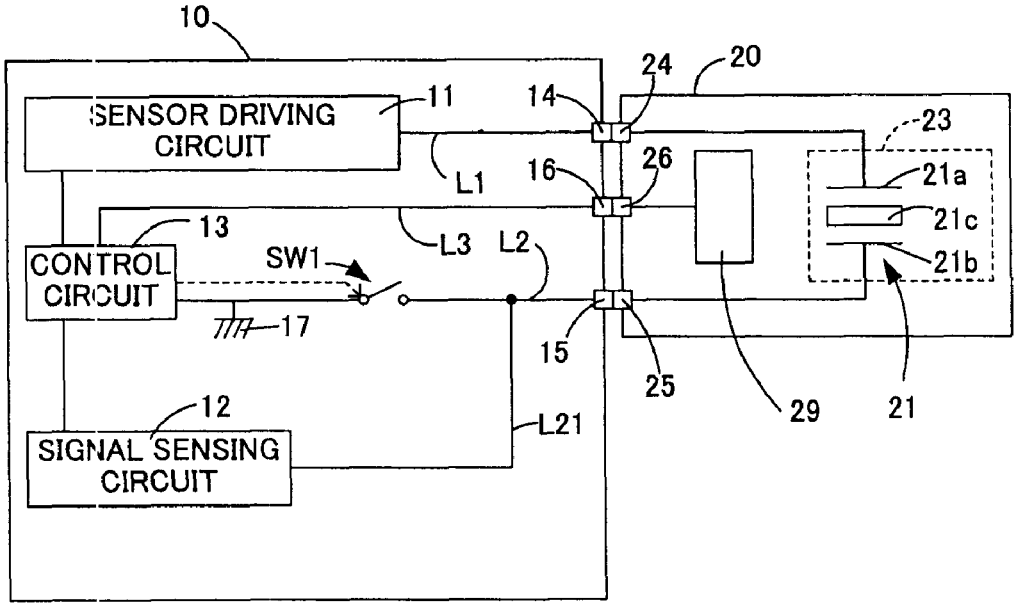
FIG. 9 is an illustration depicting alternative configurations of the liquid sensing device and the ink cartridge in First embodiment.

Alternative Configurations of the Liquid Sensing Device 10 and the Ink Cartridge 20:

FIG. 9 is an illustration depicting alternative configurations of the liquid sensing device and the ink cartridge in First embodiment. The ink cartridge 20 depicted in FIG. 9 includes a storage device 29 for storing various kinds of information relating to the liquid contained therein, for example, liquid volume (consumed volume or remaining volume), the type of liquid, and so on. The ink cartridge 20 is also furnished with a container-side data terminal 26 that is connected to the storage device 29 via an internal signal line, for writing and reading out data to and from the storage device 29.

The liquid sensing device 10 includes an apparatus-side data terminal 16 that is disposed in contact with the container-side data terminal 26; and an internal signal line L3 that connects the apparatus-side data terminal 16 with the control circuit 13. The control circuit 13 carries out writing of data to and reading of data from the storage device 29 via the internal signal line L3, the apparatus-side data terminal 16, and the container-side data terminal 26.

As discussed previously, with the printing device 1000 according to the present embodiment, the check as to whether the ink cartridge 20 is installed in the installation portion of the printing device 1000 can be accomplished using the container-side terminals 24, 25 and the apparatus-side terminals 14, 15 which are used for sensing liquid volume in the ink cartridge 20. Consequently, the check for the installed ink cartridge 20 can carried out without the need to provide both the printing device 1000 and the ink cartridge 20 with dedicated terminals for the purpose of checking whether the ink cartridge 20 is installed. As a result, it will be possible to reduce the number of required terminals in the printing device 1000 and the ink cartridge 20, and to limit or prevent diminished reliability associated with faulty contact. Moreover, production costs of the printing device 1000 and the ink cartridge 20 can be lower, in association with the smaller number of terminals.

With the printing device 1000 according to the present embodiment, the attachment check process is executed repeatedly at prescribed intervals, so installation or detachment of the liquid container can be sensed promptly.

B. Modifications of First Embodiment (1) Besides the attachment check method in the preceding embodiment, the check for an installed ink cartridge 20 could instead be carried out based on whether a unique signal waveform is sensed from the liquid sensing portion 21. For example, where a piezoelectric element 21*c* is employed as the liquid sensing portion 21, this check can be made on the basis of the unique discharge characteristic (damping time constant) of the piezoelectric element. Specifically, taking note of the unique return voltage of the piezoelectric element, installation of the ink cartridge 20 (electrical connection of the piezoelectric element) can be sensed by checking, on the basis of the damping time constant of the sense result signal, whether a sense result signal output from the piezoelectric element has been sensed.

(2) The attachment check methods described in the above embodiments may be used in combination. Specifically, different check methods may be employed at timing coincident with different attachment checks. By employing several check methods in this way, sensor error due to exogenous noise can be limited or prevented.

(3) In the preceding embodiments, the attachment check process is carried out repeatedly at prescribed time intervals; however, the sensing frequency (time interval) may be variable depending on the position of the ink cartridge 20 in the printing device 1000, e.g. on the position of the carriage (ink cartridge) in the printing device 1000. As a specific example, at times that the carriage is at a location where replacement of the ink cartridge 20 is possible, the sensing frequency could be higher; while at times that the carriage is at a location where replacement of the ink cartridge 20 is not possible, the sensing frequency could be lower, or sensing could be eliminated altogether. In this case it will be possible for the attachment check process to be carried out at locations having a higher probability of installation or detachment of the ink cartridge 20 so that the attachment check process can be carried out with greater efficiency.

C. Second Embodiment

Figure 10:
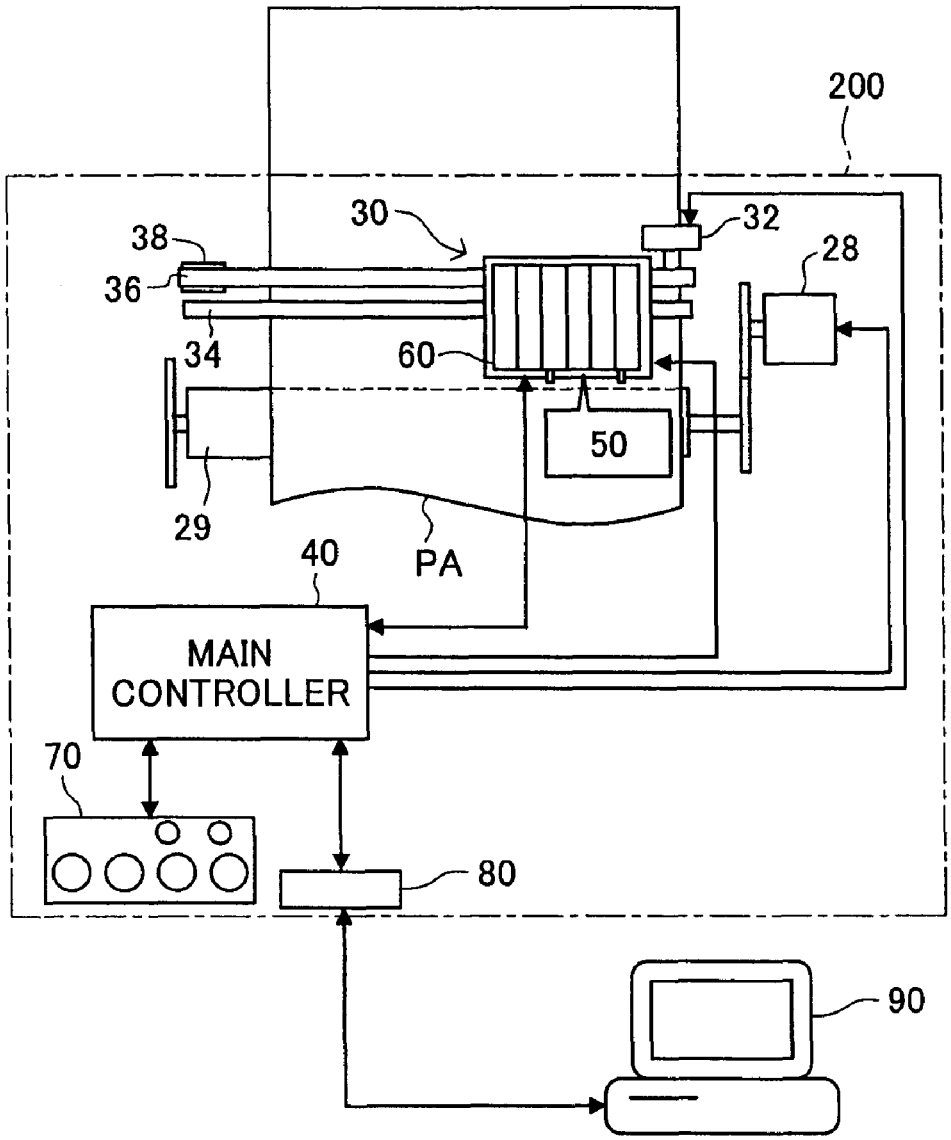
FIG. 10 is an illustration depicting a general configuration of a printing system in Second embodiment.

Printing System Configuration:

FIG. 10 is an illustration depicting a general configuration of a printing system in Second embodiment. The printing system of Second embodiment includes a printer 200 as the printing device, and a computer 90. The printer 200 is connected to the computer 90 via a connector 80.

The printer 200 includes a sub-scan feed mechanism, a main scan feed mechanism, a head driving mechanism, and a main controller 40. The sub-scan feed mechanism includes a paper feed motor 28 and a platen 27; rotation of the paper feed motor 28 is transmitted to the platen 27 in order to advance paper PA in the sub-scanning direction. The main scan feed mechanism includes a carriage motor 32; a pulley 38; a drive belt 36 stretched between the carriage motor and the pulley; and a slide rail 34 disposed parallel to the axis of the platen 27. The slide rail 34 slidably retains a carriage 30 that is affixed to the drive belt 36. Rotation of the carriage motor 32 is transmitted to the carriage 30 via the drive belt 36 so that the carriage 30 undergoes reciprocating motion along the slide rail 34 in the axial direction of the platen 27 (main scanning direction). The head driving mechanism includes a print head unit 60 that is carried on the carriage 30, and is adapted to drive the print head and jet ink onto the paper PA. The main controller 40 controls the above mechanisms to carry out the printing process. The main controller 40, for example, receives a print job from a user via the computer 90, and on the basis of the content of the received print job controls the above mechanisms to carry out the printing process. The print head unit 60 accommodates detachable installation of a plurality of ink cartridges, as will be discussed later. Specifically, the ink cartridges for delivering ink to the print head are provided on the print head unit 60 in a manner permitting them to be attached or detached through user operation. The printer 200 additionally includes a user-interface portion 70 allowing the user to make various printer settings or to check the status of the printer.

Figure 11A:
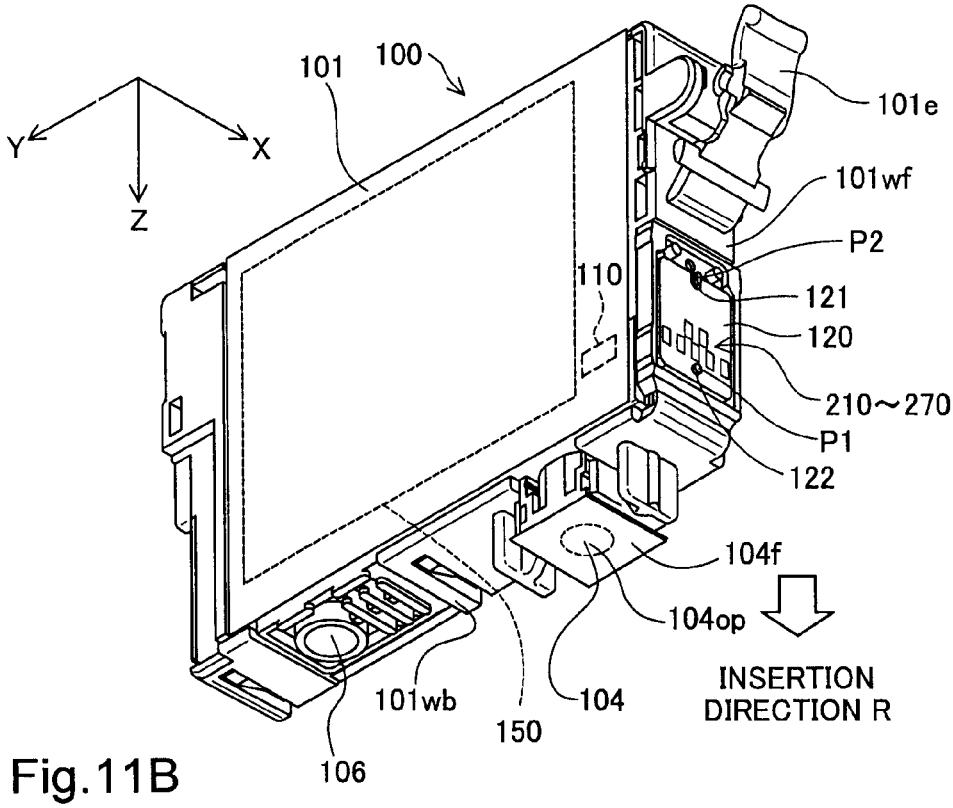
FIGS. 11A-B are perspective views depicting the configuration of the ink cartridge according to Second embodiment.
Figure 11B:
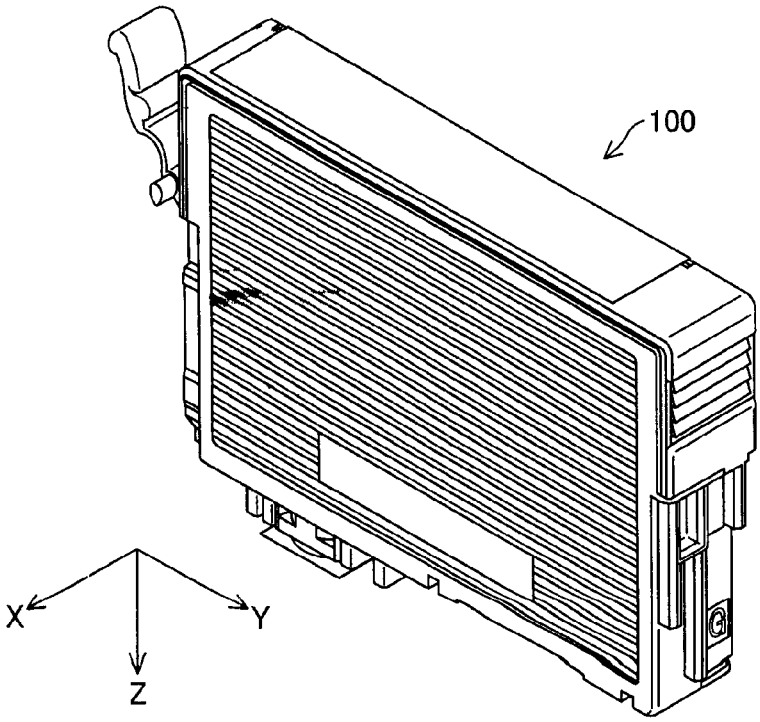
Figure 12A:
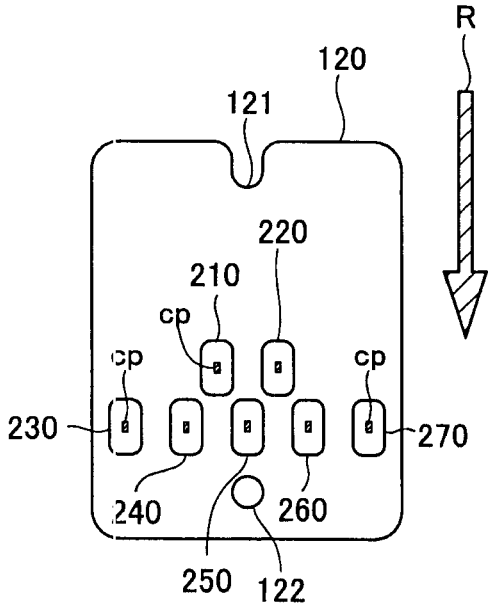
FIGS. 12A-B are diagrams depicting a configuration of a circuit board according to Second embodiment.
Figure 12B:
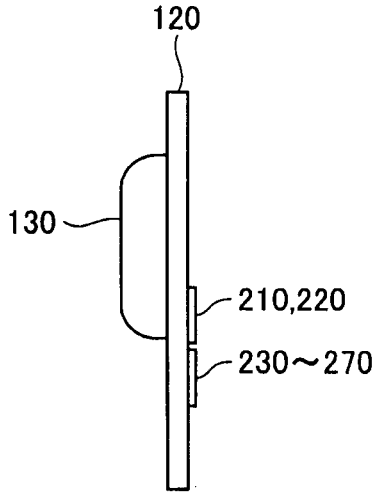
Figure 13:
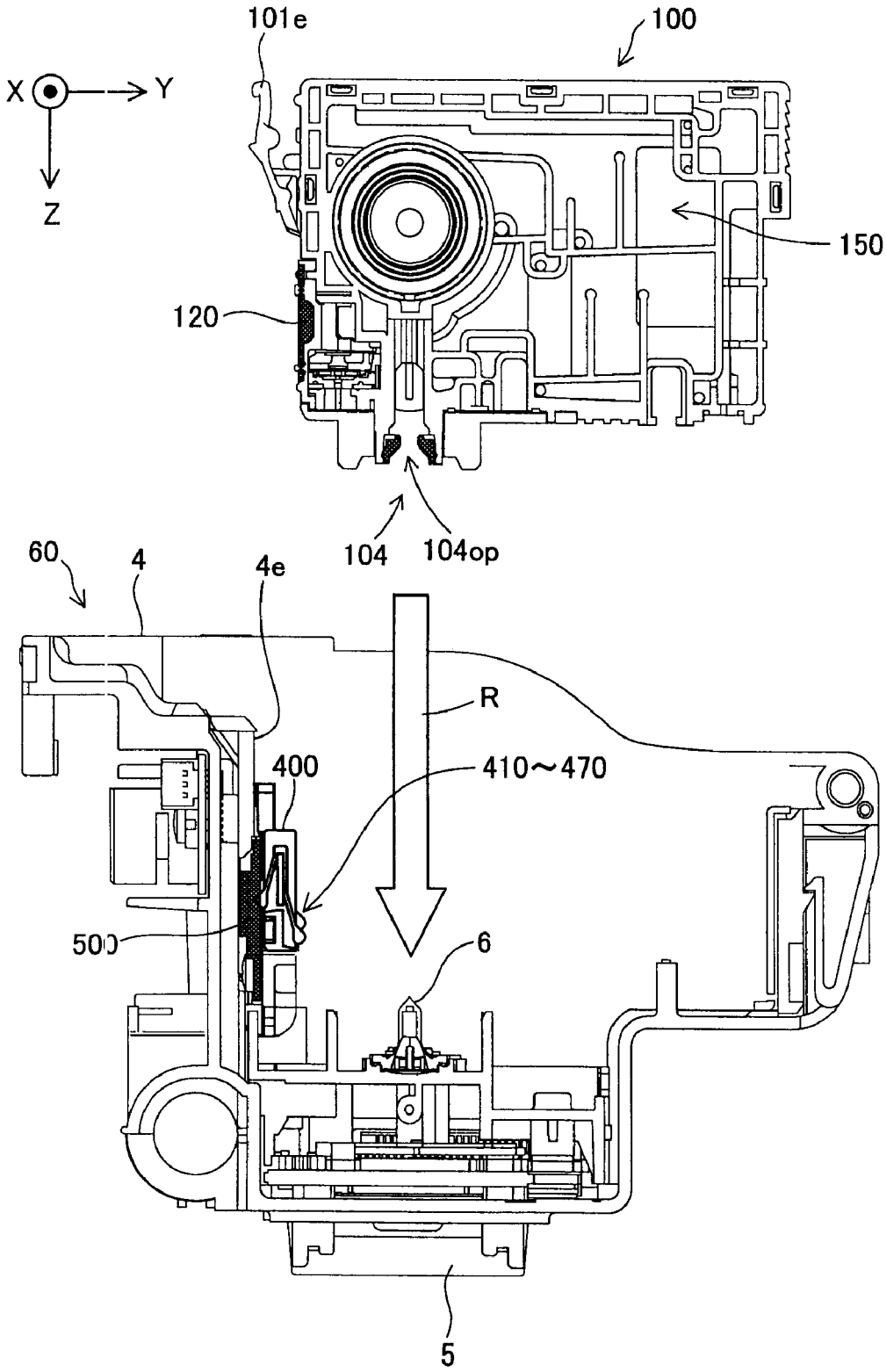
FIG. 13 is a diagram depicting a configuration of a print head unit.

The configuration of the ink cartridge (liquid container) and the configuration of the printer 200 are discussed further, making reference to FIGS. 11 to 13. FIG. 11 is a perspective view depicting the configuration of the ink cartridge according to Second embodiment. FIG. 12 is a diagram depicting a configuration of a printed circuit board (hereinafter, simply 'circuit board') according to Second embodiment. FIG. 13 is a diagram depicting a configuration of a print head unit.

The ink cartridge 100 includes a casing 101 containing the ink; a circuit board 120; and a sensor 110. An ink delivery opening 104 for delivering ink to the print head unit 60 when the cartridge is attached to the print head unit 60 is provided on the bottom face of the casing 101. An ink chamber 150 for holding the ink is formed in the casing 101. The ink delivery opening 104 communicates with the downstream side of the ink chamber 150. The mouth 104*op* of the ink delivery opening 104 is sealed by a film 104*f*. By installing the ink cartridge 100 in the print head unit 60 (FIG. 13), the film 104*f* becomes punctured, and an ink delivery needle 6 inserts into the ink delivery opening 104 (FIG. 13). The ink contained in the ink chamber 150 will then be delivered to the print head of the printer 200 through the ink delivery needle 6. The bottom face of the housing 101 is further provided with an air intake hole 106 for drawing air into the ink chamber as the ink is consumed. The air intake hole 106 communicates with the upstream side of the ink chamber 105.

The sensor 110 is secured in the interior of the casing 101. As will be discussed later, the sensor 110 includes a piezoelectric element of a piezoelectric body sandwiched by two opposed electrodes, and is employed for sensing remaining ink volume. The casing 101 includes a front wall 101*wf* (the wall in the −Y direction) and a bottom wall wb (the wall in the +Z direction). The front wall 101*wf* intersects the bottom wall wb (in the present embodiment, at substantially right angle). The circuit board 120 is secured to the front wall 101*wf*. The circuit board 120 is furnished on its outside face with terminals 210 to 270.

Two projections P1, P2 are formed on the front wall wf. These projections P1, P2 project out in the −Y direction. The circuit board 120 includes a hole 122 and a notch 121 adapted to respectively receive these projections P1, P2 (FIG. 12A). The hole 122 is formed at the center of the edge of the circuit board 120 lying towards the ink delivery opening 104 (the edge lying towards the +Z direction), while the notch 121 is formed at the center of the edge of the circuit board 120 lying towards opposite side from the ink delivery opening 104 (the edge lying towards the −Z direction). With the circuit board 120 mounted on the front wall 101*wf*, the projections P1, P2 respectively insert into the hole 122 and the notch 121. During manufacture of the ink cartridge 100, once the circuit board 120 has been mounted on the front wall 101*w*, the distal ends of the projections P1, P2 are collapsed, thereby securing the circuit board to the front wall 101*wf*.

A mating projection 101*e* is also provided on the front wall 101*f*. The mating projection 101*e* mates with a mating aperture 4*e* provided to a holder 4 (FIG. 13), thereby preventing the ink cartridge 100 from becoming inadvertently dislodged from the holder 4.

The configuration of the print head unit 60 and the condition of attachment of the ink cartridge 100 in the print head unit 60 are described making reference to FIG. 13. As depicted in FIG. 13, the print head unit 60 includes the holder 4, a connection mechanism 400, a print head 5, and a sub-controller board 500. On the sub-controller board 500 there are mounted a carriage circuit 50 and a group of terminals for respective connection, via the connection mechanism 400, to the terminals 210 to 270 of the circuit board 120 of the ink cartridge 100. The holder 4 is designed to accommodate installation of a plurality of ink cartridges 100, and is situated on top of the print head 5. The connection mechanism 400 includes conductive connection terminals 410 to 470, provided for each individual terminal of the circuit board 120, for providing electrical connection between the terminals provided to the circuit board 120 of the ink cartridge 100 and the corresponding terminals in the terminal group provided on the sub-controller board 500. The ink delivery needle 6 mentioned earlier for delivering ink to the print head 5 from the ink cartridge 100 is situated on the print head 5. The print head 5 includes a plurality of nozzles and a plurality of piezoelectric elements (piezo elements), and is adapted to eject ink droplets from the nozzles in response to voltage applied to the piezoelectric elements, to produce dots on the paper PA. The carriage circuit 50 is a circuit that cooperates with the main controller 40 to carry out control relating to the ink cartridges 100, and hereinbelow is called the sub-controller.

The ink cartridge 100 is attached to the holder 4 by being inserted from the positive direction along the Z axis (the insertion direction R) in FIG. 13. In this way the ink cartridge 100 is detachably attached to the printer 200. The circuit board 120 mounted on the ink cartridge 100 is attached to or detached from the printer 200 in association with attachment or detachment of the ink cartridge 100 by the user. The circuit board 120 electrically connects to the printer 200 when the ink cartridge 100 is installed in the printer 200.

Returning to FIG. 12, the circuit board 120 is discussed further. The arrow R in FIG. 12A indicates the direction of insertion of the ink cartridge 100 mentioned above. As shown in FIG. 12B, the circuit board 120 is furnished on its back face (the face on the back side of the face that connects with the printer 200) with a storage device 130, and on its front face (the face that connects with the printer 200) with a terminal group includes seven terminals. In the present embodiment, the storage device 130 is a semiconductor storage device that includes a ferroelectric memory cell array. The memory cell array stores data of various kinds relating to the ink or to the ink cartridge 100, such as ink consumption or ink color. Ink consumption is data that indicates the cumulative amount of ink consumed in printing and in association with cleaning of the head, for the ink contained in the ink cartridge in question. The data may indicate the amount of ink per se, or the data may indicate the amount of consumed ink as a proportion of a standard amount based on the amount of ink originally contained in the ink cartridge.

The terminals on the front face of the circuit board 120 are generally oblong in shape and arranged so as to form two rows generally perpendicular to the insertion direction R. Of the two rows, the row lying towards the insertion direction R (the leading edge side in the direction of insertion when inserted), i.e. towards lower side in FIG. 12A, shall be termed the lower row; and the row lying to the opposite side from the insertion direction R, i.e. towards upper side in FIG. 12A, shall be termed the upper row. The terms 'upper side' and 'lower side' herein are used for convenience in description in FIG. 12. The terminals that make up the upper row and the terminals that make up the lower row are arranged differently from one another in a staggered arrangement such that the terminal centers do not line up with one another in the insertion direction R.

The terminals which are arrayed to make up the upper row are, in order from the center left side in FIG. 12A, a ground terminal 210 and a power supply terminal 220. The terminals which are arrayed to make up the lower row are, in order from the center left side in FIG. 12A, a first sensor connection terminal 230, a reset terminal 240, a clock terminal 250, a data terminal 260, and a second sensor connection terminal 270. The five terminals situated in proximity to the center in the horizontal direction, i.e. the ground terminal 210, the power supply terminal 220, the reset terminal 240, the clock terminal 250, and the data terminal 260, are respectively connected to the storage device 130 via wiring patterns on the front and back faces of the circuit board 120 and through-holes formed through the circuit board 120 (not shown). The two terminals situated at the ends of the lower row, i.e. the first sensor connection terminal 230 and the second sensor connection terminal 270, are respectively connected to one electrode and the other electrode of a piezoelectric element included in the sensor 110. As is understood from the preceding description, the first sensor connection terminal 230 and the second sensor connection terminal 270 are situated at the two ends of the group of seven terminals. The five terminals 210, 220, 240, 250, 260 that are connected to the storage device 120 are situated between the first sensor connection terminal 230 and the second sensor connection terminal 270.

On the circuit board 120, the five terminals that are connected to the storage device 130, and the two terminals that are connected to the sensor 110, are situated in proximity to one another. Thus, in the connection mechanism 400 located on the printer 200 side as well, the connection terminals 410, 420, and 440 to 460 that correspond to the five terminals connected to the storage device 130, as well as the connection terminals 430, 470 that correspond to the two terminals connected to the sensor 110, are situated in proximity to one another.

When the ink cartridge 100 is attached to the holder 4, the terminals of the circuit board 120 is placed in contact with and electrically connected to the connection terminals 410 to 470 of the connection mechanism 400. Additionally, the connection terminals 410 to 470 of the connection mechanism 400 are placed in contact with and electrically connected to the terminal group on the sub-controller board 500; and the terminal group of the sub-controller board 500 are electrically connected to the sub-controller (carriage circuit) 50. Thus, the terminals 210 to 270 of the circuit board are electrically connect to the sub-controller 50 when the ink cartridge 100 is attached to the holder 4. In FIG. 12, the contact portions cp indicated by hatching on the terminals 210 to 270 represent contact portions that come into contact against the connection terminals 410 to 470 of the connection mechanism 400 when the ink cartridge 100 is attached to the holder 4. As is understood from the preceding description, the contact portion cp of the first sensor connection terminal 230 and the contact portion cp of the second sensor connection terminal 270 are situated at the two ends of the contacts portions of the group of seven terminals. The contact portions cp of the five terminals 210, 220, 240, 250, 260 connected to the storage device 130 are situated between the contact portion cp of the first sensor connection terminal 230 and the contact portion cp of the second sensor connection terminal 270. The first sensor connection terminal 230 in Second embodiment corresponds to the apparatus-side terminal in Claim 1; to the first delivery system-side terminal in Claims 6 and 11, and to the first board-side terminal in Claim 13. The second sensor connection terminal 270 in Second embodiment corresponds to the second delivery system-side terminal in Claims 6 and 11, and to the second board-side terminal in Claim 13. The five terminals 210, 220, 240, 250, 260 that are connected to the storage device 130 correspond to the third delivery system-side terminal in Claims 9 and 11. The connection terminal 430 of the connection mechanism 400 that contacts the first sensor connection terminal 230 in Second embodiment corresponds to the apparatus-side terminal in Claim 1, and to the first apparatus-side terminal in Claims 6, 11, and 13. The connection terminal 470 of the connection mechanism 400 that contacts the second sensor connection terminal 270 in Second embodiment corresponds to the second apparatus-side terminal in Claims 6, 11, and 13. The connection terminals 410, 420, 440, 450, 460 of the connection mechanism 400 that contact the five terminals 210, 220, 240, 250, 260 that are connected to the storage device 130 correspond to the third apparatus-side terminal in Claims 9, 11, and 13.

Figure 14:
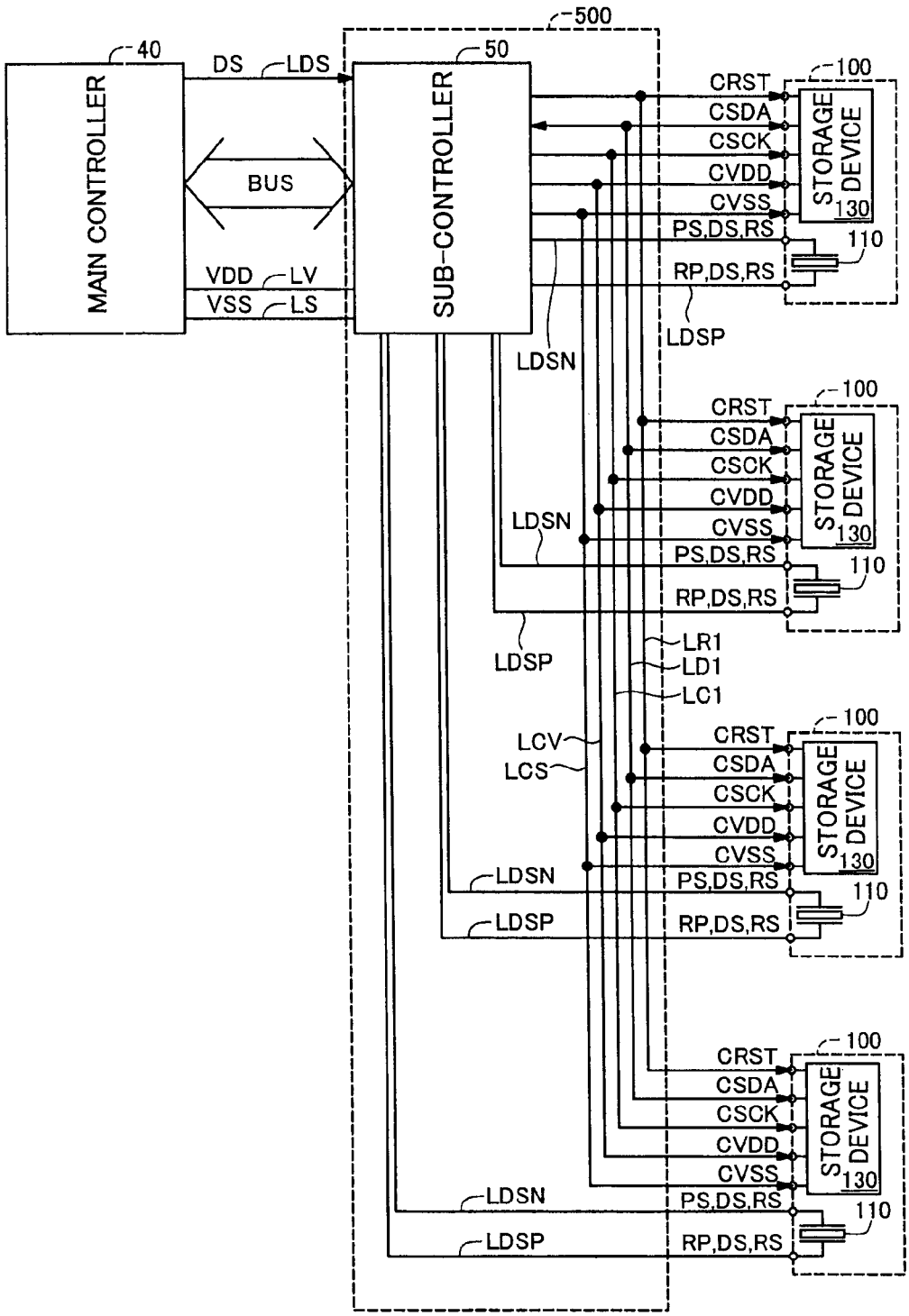
FIG. 14 is a first illustration of an electrical configuration of a printer.
Figure 15:
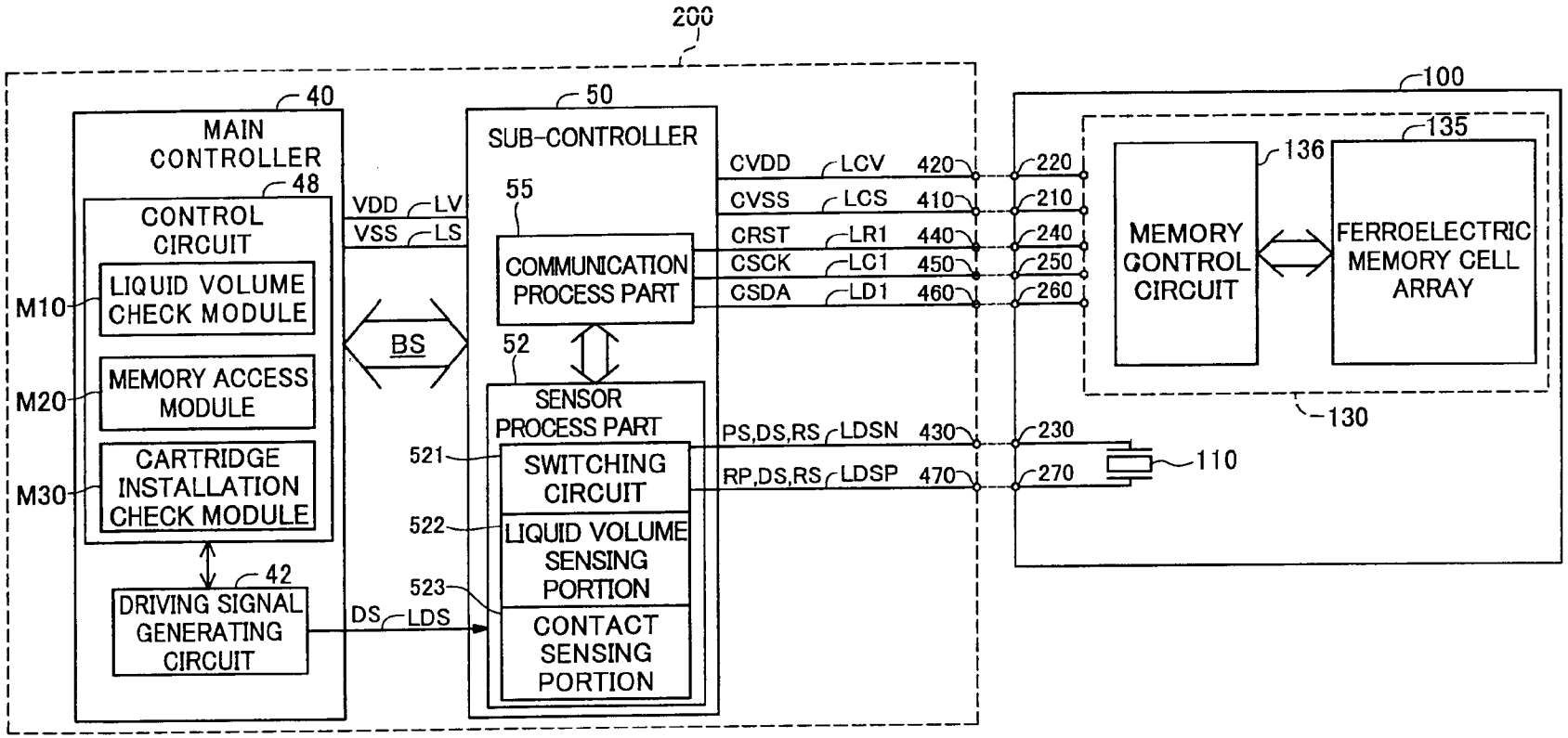
FIG. 15 is a second illustration of an electrical configuration of a printer.

Electrical Configuration of Printer:

FIGS. 14 and 15 are illustrations of an electrical configuration of a printer. FIG. 14 is an overall depiction of the main controller 40, the sub-controller 50, and all of the ink cartridges 100 attachable to the printer. FIG. 15 depicts the functional configuration of the main controller 40 and the functional configuration of the sub-controller 50, together with a single ink cartridge 100. In the present embodiment, the sub-controller 50 carries out writing of prescribed data to the storage device 130 as the electrical device, and reading of prescribed data from the storage device 130. The sub-controller 50 also executes a contact sensing process (discussed later) which involves supplying a contact sense signal PS to the first sensor connection terminal 230, and sensing contact between the first sensor connection terminal 230 of the ink cartridge 100 and the connection terminal 430 of the printer 200, and contact between the second sensor connection terminal 270 of the ink cartridge 100 and the connection terminal 470 of the printer 200. The sub-controller 50 further executes a liquid volume sensing process (discussed later) which involves supplying a liquid volume sense signal DS to the first sensor connection terminal 230, and sensing whether the volume of ink in the ink cartridge 100 is equal to or less than a prescribed value.

Different 8-bit ID numbers (identifying information) are assigned to the storage devices 130 of the ink cartridges 100. As shown in FIG. 5, the storage devices 130 of the ink cartridges 100 are connected in parallel to lines from the sub-controller 50 (i.e. they are bus-connected to the sub-controller 50), so when a process such as read/write operation to the storage device 130 of a particular ink cartridge 100 from the sub-controller 50 is to be carried out, it is necessary to identify the ink cartridge from the main controller 40 and sub-controller 50. The ID number is utilized for this purpose. The ID number is used in order to specify a particular storage device 130 (ink cartridge 100) to be accessed by the sub-controller 50.

The lines that electrically connect the sub-controller 50 with the ink cartridges 100 are composed of lines that connect the sub-controller 50 to the terminal group of the sub-controller board 500, the connection terminals 410 to 470 of the connection mechanism 400, the terminal group on the back side of the circuit board 120, and lines leading from the terminal group on the back side of the circuit board 120 to the sensor 110. The lines that electrically connect the sub-controller 50 to the ink cartridges 100 include a reset signal line LR1, a clock signal line LC1, a data signal line LD1, a first ground line LCS, a first power supply line LCV, a first sensor connection signal line LDSN, and a second sensor connection signal line LDSP.

The reset signal line LR1 between the sub-controller 50 and the storage device 130 is a conductive line for supplying a reset signal CRST from the sub-controller 50 to the storage device 130. The reset signal is a signal by which the sub-controller 50 places a memory control circuit 136 (discussed later) of the storage device 130 in the initial state, or in a standby state in which access is enabled. When a low level reset signal is supplied to the memory control circuit 136 by the sub-controller 50, the memory control circuit 136 will assume the initial state. The clock signal line LC1 between the sub-controller 50 and the storage device 130 is a conductive line for supplying a clock signal CSCK from the sub-controller 50 to the storage device 130. The data signal line LD1 between the sub-controller 50 and the storage device 130 is a conductive line for forwarding data signals CSDA which are exchanged between the sub-controller 50 and the storage device 130. Each of these three lines LR1, LC1, LD1 is a line that on the sub-controller 50 side has a single terminus, and that on the ink cartridge 100 side is branched into termini equal in number to the ink cartridges 100. That is, the three lines LR1, LC1, LD1 serve to bus-connect the plurality of storage devices 130 to the sub-controller 50.

The first ground line LCS is a conductive line for supplying ground potential CVSS to the storage device 130, and is electrically connected to the storage device 130 via the ground terminal 210 of the circuit board 120. The first ground line LCS is a line that on the sub-controller 50 side has a single terminus, and that on the ink cartridge 100 side is branched into termini equal in number to the ink cartridges 100. The ground potential CVSS is connected to the ground potential VSS (=CVSS potential) which is supplied to the sub-controller 50 by the main controller 40 via the second ground line LS, and is set to low level (0 V).

The first sensor connection signal line LDSN and the second sensor connection signal line LDSP are lines that, in the liquid volume sensing process to be discussed later, are used for supplying a liquid volume sense signal DS from the sub-controller 50 to the piezoelectric element of the sensor 110 via connection terminals 410, 470; and after application of the liquid volume sense signal DS has ceased, for transmitting to the sub-controller 50 a liquid volume response signal RS generated by the piezoelectric effect of the piezoelectric element. Also, the first sensor connection signal line LDSN is a conductive line for supplying the connection terminal 430 with a contact sense signal PS from the sub-controller 50 in a contact sensing process to be discussed later; and the second sensor connection signal line LDSP is a conductive line for receiving from the connection terminal 470 a contact response signal RP that corresponds to the contact sense signal PS, in the contact sensing process to be discussed later. The first sensor connection signal line LDSN and the second sensor connection signal line LDSP respectively include a plurality of lines provided individually for the ink cartridges 100 and that on the sub-controller 50 side have a single terminus, and whose other terminus connects respectively to the first sensor connection terminal 230 or second sensor connection terminal 270 of the circuit board 120 when the ink cartridge 100 is attached. As a result, the first sensor connection signal line LDSN is electrically connected to one of the electrodes of the piezoelectric element of the sensor 110 via the first sensor connection terminal 230, while the second sensor connection signal line LDSP will be electrically connected to the other electrode of the piezoelectric element of the sensor 110 via the second sensor connection terminal 270.

The first power supply line LCV is a conductive line for supplying power supply voltage CVDD to the storage device 130, and when the ink cartridge 100 is attached connects to the storage device 130 via the power supply terminal 220 of the circuit board 120. The first power supply line LCV is a line that on the sub-controller 50 side has a single terminus, and that on the ink cartridge 100 side is branched into termini equal in number to the ink cartridges 100. The high level power supply voltage CVDD used to drive the storage devices 130 has potential of about 3.3 V versus low level ground potential CVSS (0 V). Of course, the potential level of the power supply voltage CVDD could be a different potential, e.g. 1.5 V or 2.0 V, depending on the processor generation of the storage devices 130.

The main controller 40 and the sub-controller 50 are electrically interconnected by a plurality of lines. These lines include a bus BS, a second power supply line LV, a second ground line LS, and a third sensor connection signal line LDS. The bus BS is used for data transmission between the main controller 40 and the sub-controller 50. The second power supply line LV and the second ground line LS are conductive lines that respectively deliver power supply voltage VDD and ground potential VSS from the main controller 40 to the sub-controller 50. The power supply voltage VDD has the same level as the aforementioned power supply voltage CVDD which is supplied to the storage devices 130, e.g. potential of about 3.3 V versus low level ground potential VSS and CVSS (0 V). Of course, the potential level of the power supply voltage VDD could be a different potential, e.g. 1.5 V or 2.0 V, depending on the processor generation of the logic IC section of the sub-controller 50. The third sensor connection signal line LDS is a conductive line for delivering a liquid volume sense signal DS (described later) that is ultimately intended for application to the sensors 110 in the liquid volume sensing process, from the main controller 40 to the sub-controller 50.

The main controller 40 includes a control circuit 48, a driving signal generating circuit 42, and ROM, RAM, EEPROM or the like (not shown). Various programs for controlling the printer 200 are stored in ROM.

The control circuit 48 is a CPU (central processing unit), and in cooperation with the ROM, RAM, EEPROM or other memory executes control of the printer 200 as a whole. The control circuit 48 includes as functional blocks a liquid volume check module M10, a memory access module M20, and a cartridge attachment check module M30.

The liquid volume check module M10 controls the sub-controller 50 and the driving signal generating circuit 42 to supply a liquid volume sense signal DS to the sensor 110 of the ink cartridge 100, then decide whether the ink volume in the ink cartridge 100 is equal to or greater than a prescribed value. The memory access module M20, via the sub-controller 50, accesses the storage device 130 of the ink cartridge 100, and either reads information that is stored in the storage device 130 or updates the information that is stored in the storage device 130. The cartridge attachment check module M30 controls the sub-controller 50 to supply a contact sense signal PS to the sensor 110 of the ink cartridge 100, then decides whether the ink cartridge 100 is currently attached.

The EEPROM of the main controller 40 stores data that represents the liquid volume sense signal DS for driving the sensor. The driving signal generating circuit 42, in accordance with an instruction from the liquid volume check module M10 of the control circuit 48, reads out from the EEPROM data that represents a waveform for the liquid volume sense signal DS, and then generates a liquid volume sense signal DS having a given waveform. The liquid volume sense signal DS includes higher potential than the power supply voltage VDD (in the present embodiment, 3.3 V); the present embodiment, maximum potential of about 36 V for example.

In the present embodiment, the driving signal generating circuit 42 can additionally generate a head driving signal to be supplied to the print head 5. That is, in the present embodiment, the control circuit 48 causes the driving signal generating circuit 42 to generate a liquid volume sense signal DS when executing a check of liquid volume, and causes the driving signal generating circuit 42 to generate a head driving signal when executing printing.

The sub-controller 50 is provided with an ASIC (Application Specific IC) by way of hardware configuration. The ASIC has as functional constituents a communication process part 55 and a sensor process part 52.

The communication process part 55 carries out a communication process with the storage devices 130 of the ink cartridges 100 via the reset signal line LR1, the data signal line LD1, and the clock signal line LC1. The communication process will not be discussed in detail here.

If the main controller 40 determines that the circuit board 120 is electrically connected to the printer 200 and that the ink cartridge 100 has been attached in the printer 200, at prescribed timing it will perform access to the storage device 130 of the ink cartridge 100 via the communication process part 55.

The sensor process part 52 includes a switching circuit 521, a liquid volume sensing portion 522 for executing a liquid volume sensing process, and a contact sensing portion 523 for executing a contact sensing process. These will be discussed in detail later.

The description now turns to the electrical configuration of the ink cartridge 100. The ink cartridge 100 has as its electrical constituent components the storage device 130 and the sensor 110.

The storage device 130 includes a ferroelectric memory cell array 135 as a data storage portion, and a memory control circuit 136. As indicated by white circles on the broken lines that represent the storage device 130 in FIG. 15, the storage device 130 includes a ground terminal that is electrically connected to the ground terminal 210 of the circuit board 200; a power supply terminal that is electrically connected to the power supply terminal 220; a reset terminal that is electrically connected to the reset terminal 240; and a clock terminal that is electrically connected to the clock terminal 250.

The ferroelectric memory cell array 135 is a nonvolatile semiconductor memory cell array that employs ferroelectric bodies as storage elements, and provides a memory area having data rewriteable characteristics. The ferroelectric memory cell array 135 stores information indicating volume of ink consumed or remaining ink volume, for example.

The memory control circuit 136 is a circuit that mediates access (read and write operations) to the ferroelectric memory cell array 135 by the sub-controller 50, and is adapted to parse identifying data and command data transmitted to it by the sub-controller 50. Additionally, during write operations, the memory control circuit 136 generates write data for writing to the ferroelectric memory cell array 135, on the basis of data targeted for writing which has been received from the sub-controller 50. During read operations, the memory control circuit 136 will transmit data to the sub-controller 50 on the basis of data read out from the ferroelectric memory cell array 135.

Figure 16:
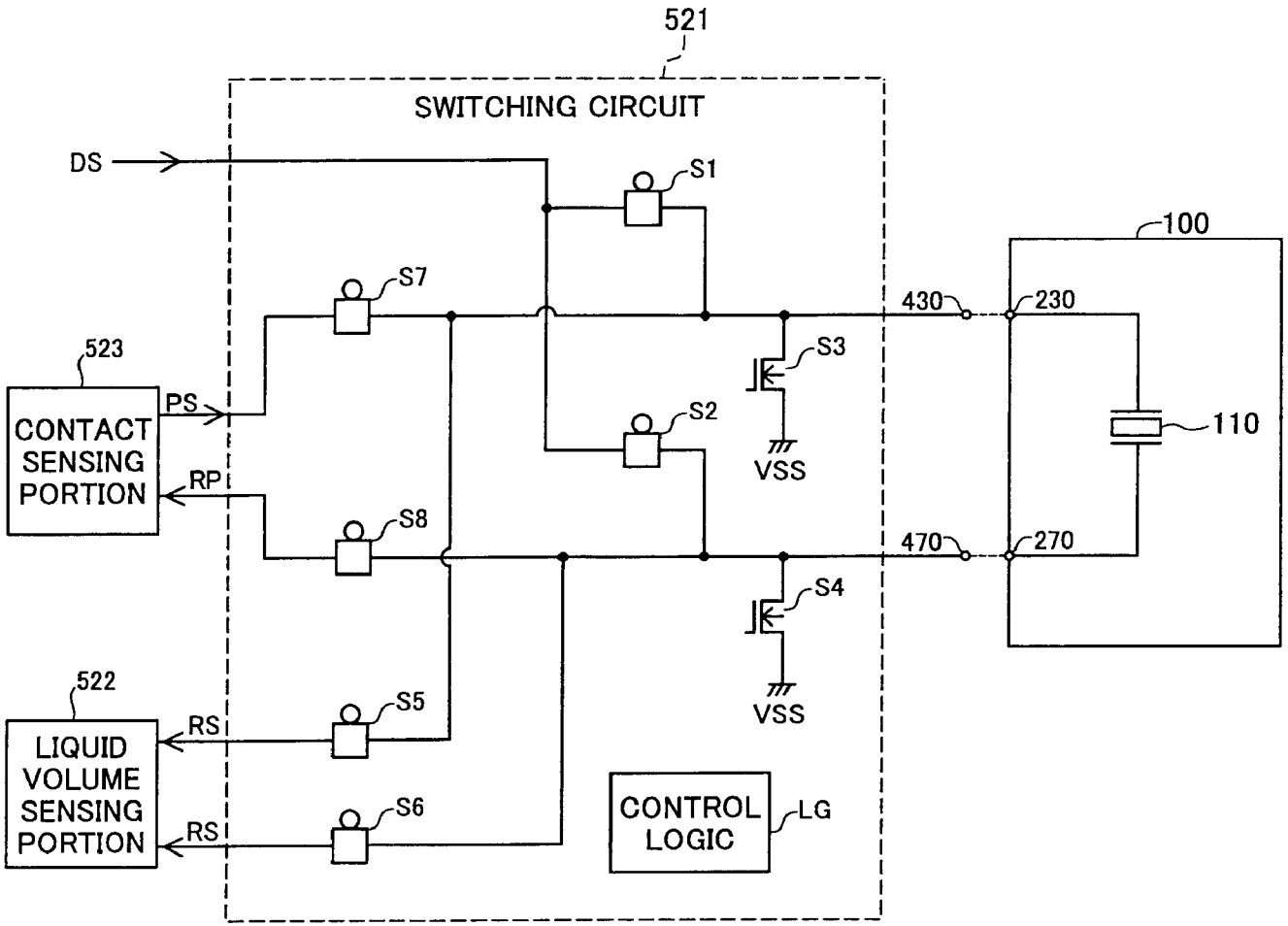
FIG. 16 is a conceptual depiction of a configuration of a switching circuit 521.

The discussion now turns to the configuration of the switching circuit 521. FIG. 16 is a conceptual depiction of a configuration of the switching circuit 521. The switching circuit 521 includes switches S1 to S8, and control logic LG. The control logic LG controls the switches S1 to S8 between the conduction state (On state) and the non-conduction state (Off state). In the present embodiment NMOS transistors are employed as the switches S3 and S4. Meanwhile, transmission gates (analog switches) are employed as the switches S1, S2 and S5 to S8.

The switch S3 is situated such that when placed in the On state it will supply stable ground voltage VSS as prescribed potential to the connecting terminal 430. The switch S4 is situated such that when placed in the On state it will supply stable ground voltage VSS as prescribed potential to the connecting terminal 470

The switch S1 and the switch S2 are switches, when supplying the liquid volume sense signal DS in the liquid volume sensing process, for selecting either the connecting terminal 430 or the connecting terminal 470 as the terminal for supplying the liquid volume sense signal DS. When the contact sensing process is carried out, both the switch S1 and the switch S2 are in the Off state.

The switch S5 and the switch S6 are switches for selecting either the connection terminal 430 or the connection terminal 470 as the terminal for receiving the liquid volume response signal RS in the liquid volume sensing process. When the contact sensing process is carried out, both the switch S5 and the switch S6 are in the Off state.

The switch S7 and the switch S8 are switches that are placed in the On state during the contact sensing process. When the liquid volume sensing process is carried out, both the switch S7 and the switch S8 are in the Off state.

FIG. 17 is a table summarizing operation of the switches S1 to S8 in a liquid volume sensing process and in a contact sensing process. As shown in FIG. 17, there are six different patterns, denoted as Liquid Volume Sensing Processes 1 to 6, for the liquid volume sensing process for the liquid volume sensing process. Liquid Volume Sensing Process 1 is a pattern in which a liquid volume sense signal DS is supplied to the connection terminal 430, and a liquid volume response signal RS is received from the connection terminal 430. Liquid Volume Sensing Process 2 is a pattern in which a liquid volume sense signal DS is supplied to the connection terminal 430, and a liquid volume response signal RS is received from the connection terminal 470. Liquid Volume Sensing Process 3 is a pattern in which a liquid volume sense signal DS is supplied to the connection terminal 430, and a liquid volume response signal RS is received from both the connection terminal 430 and the connection terminal 470. Liquid Volume Sensing Process 4 is a pattern in which a liquid volume sense signal DS is supplied to the connection terminal 470, and a liquid volume response signal RS is received from the connection terminal 430. Liquid Volume Sensing Process 5 is a pattern in which a liquid volume sense signal DS is supplied to the connection terminal 470, and a liquid volume response signal RS is received from the connection terminal 470. Liquid Volume Sensing Process 6 is a pattern in which a liquid volume sense signal DS is supplied to the connection terminal 470, and a liquid volume response signal RS is received from both the connection terminal 430 and the connection terminal 470.

As shown in FIG. 17, when a liquid volume sense signal DS is being supplied to the connection terminal 430 in the liquid volume sensing process) the switch S1 and the switch S4 will assume the On state, and the other six switches will assume the Off state. On the other hand, when a liquid volume sense signal DS is being supplied to the connection terminal 470 in the liquid volume sensing process, the switch S2 and the switch S3 will assume the On state, and the other six switches will assume the Off state. When a liquid volume response signal RS is being received from the connection terminal 430 in the liquid volume sensing process, the switch S4 and the switch S5 will assume the On state, and the other six switches will assume the Off state. On the other hand, when a liquid volume response signal ES is being received from the connection terminal 470 in the liquid volume sensing process, the switch S3 and the switch S6 will assume the On state, and the other six switches will assume the Off state. When a liquid volume response signal RS is being received from both the connection terminal 430 and the connection terminal 470 in the liquid volume sensing process, the switch S5 and the switch S6 will assume the On state, and the other six switches will assume the Off state.

Liquid Volume Sensing Process

Figure 18:
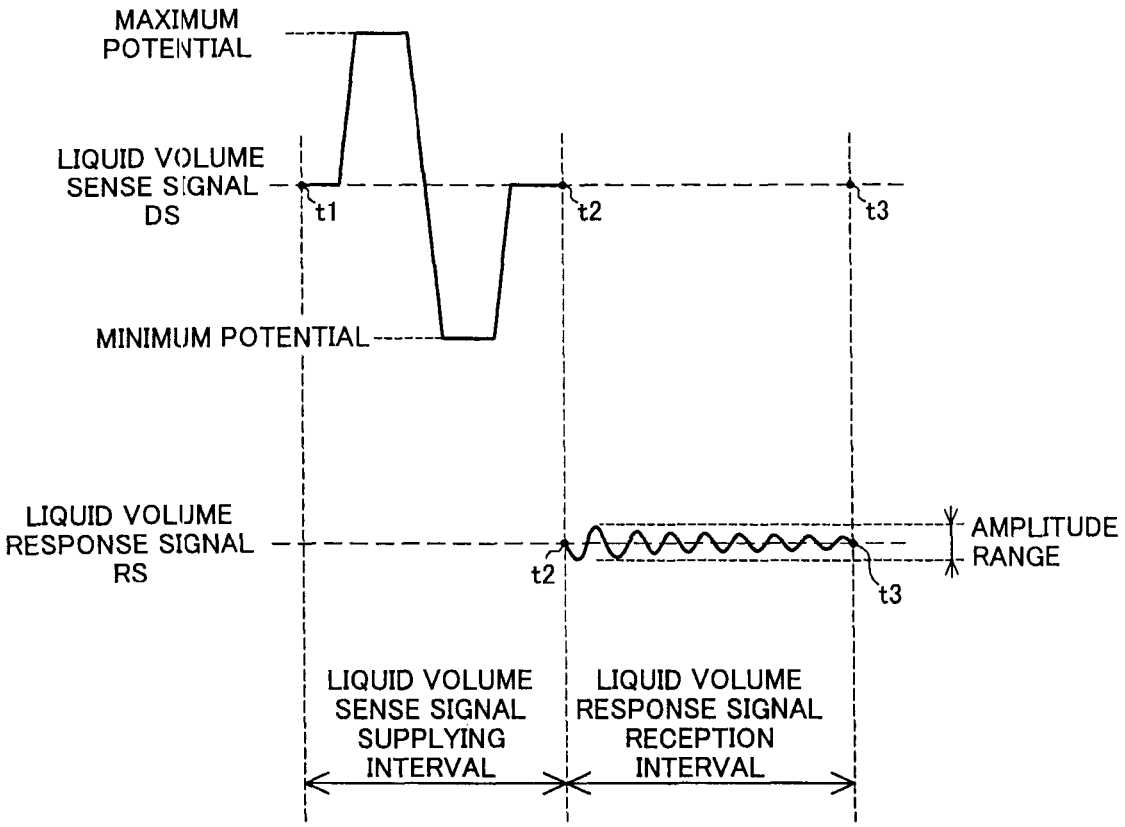
FIG. 18 is a timing chart illustrating a liquid volume sensing process in Second Embodiment.

FIG. 18 is a timing chart illustrating a liquid volume sensing process in Second embodiment. Liquid Volume Sensing Process 1 will be described by way of example. The sub-controller 50 executes the liquid volume sensing process in accordance with an instruction sent from the liquid volume check module M10 of the main controller 40 via the bus BS. First, during the liquid volume sense signal supplying interval from time t1 to time t2, the switch S1 and the switch S4 are placed in the On state, and the other six switches are placed in the Off state, as depicted in FIG. 17.

During the liquid volume sense signal supplying interval, the connection terminal 430 is presented with a liquid volume sense signal DS like that shown in FIG. 18. With the ink cartridge 100 attached, the liquid volume sense signal DS that is supplied to the connection terminal 430 will be delivered to one of the electrodes of the piezoelectric element of the sensor 110 via the first sensor connection terminal 230.

The liquid volume sense signal DS is an analog signal generated with an arbitrary waveform by the driving signal generating circuit 42. For example, a signal having a waveform of a shape that combines two mutually inverted trapezoids as depicted in FIG. 18 could be used as the liquid volume sense signal DS. The maximum potential of this liquid volume sense signal DS is about 36 V where ground potential is 0 V, and the minimum potential is about 4 V where ground potential is 0 V.

During the liquid volume response signal reception interval from time t2 to time t3, the switch S4 and the switch S5 are placed in the On state, and the other six switches will be placed in the Off state, as depicted in FIG. 17. During the liquid volume response signal reception interval, the piezoelectric element provided as the sensor 110 oscillates according to the volume of ink remaining in the ink cartridge 100; and the back electromotive force generated by this oscillation is output as a liquid volume response signal RS from the piezoelectric element to the connection terminal 430 via the first sensor connection terminal 230.

As shown in FIG. 18, the liquid volume response signal RS includes an oscillating component that has a frequency corresponding to the vibration frequency of the piezoelectric element. The oscillation amplitude of this oscillating component of the liquid volume response signal RS is about 1 V, for example. The liquid volume response signal RS will be input to the liquid volume sensing portion 522 via the connection terminal 470, and its frequency is measured in the liquid volume sensing portion 522.

While the sensor 110 is not illustrated in detail, it includes a cavity (resonator portion) that defines part of an ink passage in proximity to the ink delivery opening 104; an oscillator plate that defines part of the wall face of the cavity; and a piezoelectric element arranged on the oscillator plate. When the piezoelectric element is presented with a liquid volume sense signal DS, the oscillator plate oscillates through the agency of the piezoelectric element. The frequency of the subsequent residual vibration of the oscillator plate is the frequency of the liquid volume response signal RS. The frequency of residual vibration of the oscillator plate is differ depending on whether ink is present in the cavity, so by measuring the frequency of the liquid volume response signal RS the liquid volume sensing portion 522 is able to sense whether ink is present in the cavity. Specifically, when the condition inside the cavity changes from an ink-filled condition to an air-filled condition due to consumption of the ink contained in the casing 101, the frequency of residual vibration of the oscillator plate changes as well. This change in frequency is manifested as a change in the frequency of the liquid volume response signal RS. By measuring the frequency of the liquid volume response signal RS, the liquid volume sensing portion 522 is able to sense whether ink is present in the cavity. If it is sensed that the ink in the cavity is 'depleted', this will mean that the remaining volume of ink contained in the casing 101 is equal to or less than a threshold value Vref (which corresponds to the volume of ink remaining to the downstream side of the cavity). If sensed that ink is 'present' in the cavity, this will mean that the remaining volume of ink contained in the casing 101 is greater than the threshold value Vref. The liquid volume sensing portion 522 will then notify the liquid volume check module M10 of the result of sensing whether ink is present.

Contact Sensing Process

Figure 19A:
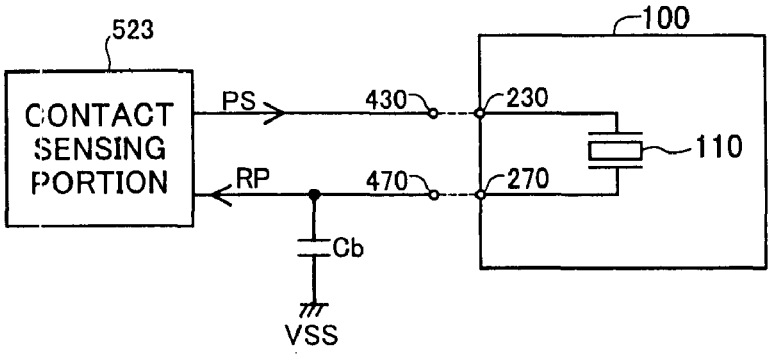
FIGS. 19A-B are diagrams for illustrating a contact sensing process in Second Embodiment.
Figure 19B:
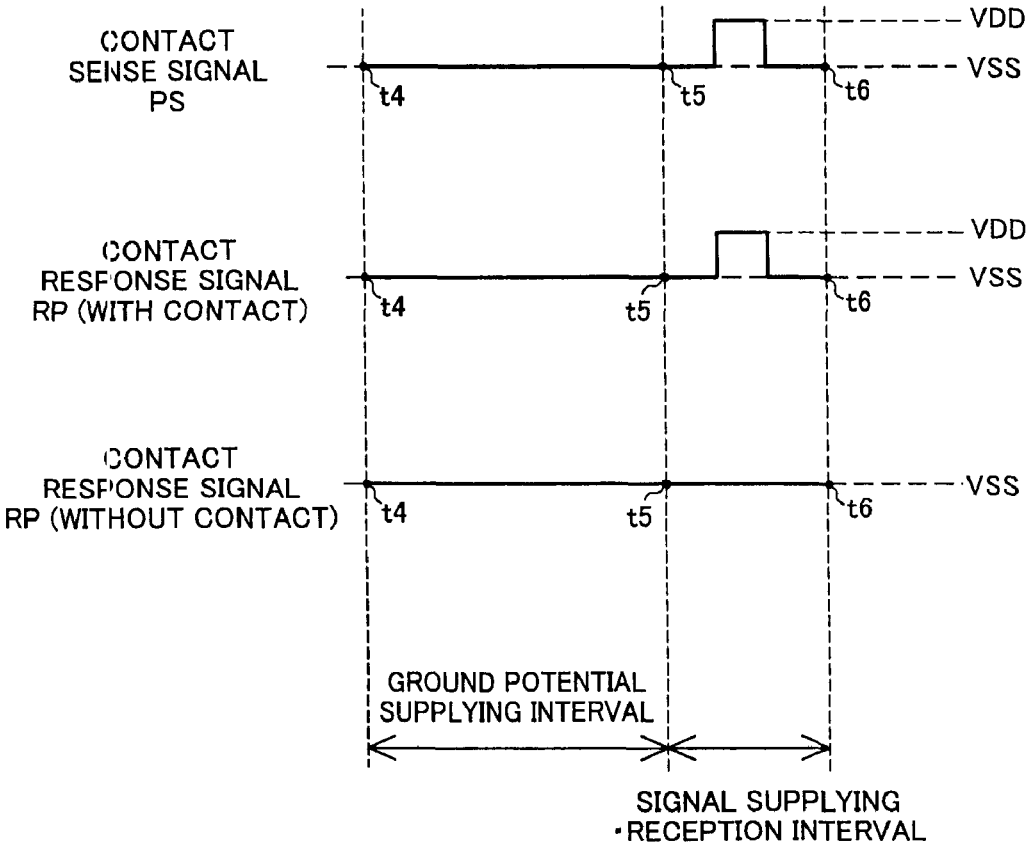

FIG. 19B is a timing chart illustrating a contact sensing process in Second embodiment. A contact sensing process is executed in accordance with an instruction sent from the cartridge attachment check module M30 of the main controller 40 via the bus BS. First, during a ground potential supplying interval from time t4 to time t5, the switch S4, the switch S7, and the switch S8 are placed in the On state, and the other five switches are placed in the Off state, as depicted in FIG. 17.

During the ground potential supplying interval, the contact sense signal PS supplied to the connection terminal 430 are maintained at low level (ground potential VSS). With the ink cartridge 100 attached, the first sensor connection terminal 230 is in contact with the connection terminal 430, so the supplied ground potential VSS will be delivered to one of the electrodes of the piezoelectric element of the sensor 110 via the first sensor connection terminal 230. Also, during the ground potential supplying interval, ground potential VSS is supplied to the connection terminal 470. With the ink cartridge 100 attached, the second sensor connection terminal 270 will be in contact with the connection terminal 470, so the supplied ground potential VSS is delivered to the other electrode of the piezoelectric element of the sensor 110 via the second sensor connection terminal 270.

During a signal supplying/reception interval from time t5 to time to following the ground potential supplying interval, the switch S7 and the switch S8 are placed in the On state, and the other six switches including switch S4 are placed in the Off state, as depicted in FIG. 17. That is, at time t5, the switch S4 switches from the On to the Off state. As a result, beginning at time t5, the connection terminal 470 which was previously supplied with ground potential VSS now assume a high impedance state. As shown in FIG. 19B, immediately after time t5, the contact sense signal PS supplied to the connection terminal 430 rises from low level to high level (VDD level). Then, immediately after rising from low level to high level (VDD level), the contact sense signal PS which is supplied to the connection terminal 430 falls from high level to low level. That is, during the signal supplying/reception interval, a pulse signal that includes a rising edge and a falling edge are supplied to the connection terminal 430 as a contact sense signal PS. At this time, if the first sensor connection terminal 230 is in contact with the connection terminal 430, and moreover the second connection terminal 270 is in contact with the connection terminal 470 (i.e. with contact), the contact response signal RS represented by the connection terminal 470 in the high impedance state is pulse signal synced with the pulse signal of the contact sense signal PS (FIG. 19B). In the ink cartridge 100, the piezoelectric element which is connected to the first sensor connection terminal 230 and to the second sensor connection terminal 270 functions as a kind of capacitive element (capacitor). The following detailed description makes reference to FIG. 19A. FIG. 19A depicts an equivalent circuit that portrays the electrical connection relationship between the sensor 110 and the contact sensing portion 523 during the contact sensing process. In FIG. 19A, capacitance Cb indicates the wire capacitance of the line for input of the contact response signal RS from the sensor 110 to the contact sensing portion 523. Here, where the voltage of the contact sense signal PS is denoted as Vp, the voltage of the contact response signal RS is denoted as Vr, and the capacitance Ca of the piezoelectric element of the sensor 110 is denoted as Ca, the voltage Vr of the contact response signal RS is given by the following expression.

$$Vr=(Ca/(Ca+Cb))Vp \quad \text{(Expression 1)}$$

It will be appreciated that if in comparison with the capacitance Ca of the piezoelectric element, the wire capacitance Cb is small enough to be ignored, then Vr≈Vp, and the contact response signal RS will be represented by a signal substantially identical to the contact sense signal PS.

Specifically, when there is contact, a pulse signal that is substantially identical to the pulse signal constituting the contact sense signal PS supplied to the first sensor connection terminal 230 is input via the connection terminal 470 to the contact sensing portion 523 as the contact response signal RS. When the contact sensing portion 523 senses the rising edge and the falling edge of the pulse signal that has been input via the connection terminal 470, it will decide that the first sensor connection terminal 230 is in contact with the connection terminal 430 and that the second sensor connection terminal 270 is in contact with the connection terminal 470. More accurately, when the contact sensing portion 523 has sensed the rising edge of the contact response signal RP within a prescribed time interval that begins at the timing of the rise of the contact sense signal PS, and has then sensed the falling edge of the contact response signal RP within a prescribed time interval that begins at the timing of the fall of the contact sense signal PS, it will decide that the first sensor connection terminal 230 is in contact with the connection terminal 430 and that the second sensor connection terminal 270 is in contact with the connection terminal 470. The cartridge attachment check module M30 is notified of the result of the decision. In the event of a decision that the first sensor connection terminal 230 is in contact with the connection terminal 430 and that the second sensor connection terminal 270 is in contact with the connection terminal 470, on the assumption that the ink cartridge 100 has been attached, the main controller 40 of the printer 200 will carry out a process such as the printing process. In another acceptable arrangement, the contact sensing portion 523 may decide that the first sensor connection terminal 230 is in contact with the connection terminal 430 and that the second sensor connection terminal 270 is in contact with the connection terminal 470 if it senses either the rising edge or the falling edge of the pulse signal that has been input via the connection terminal 470.

On the other hand, if the first sensor connection terminal 230 is not in contact with the connection terminal 430, or if the second sensor connection terminal 270 is not in contact with the connection terminal 470 (i.e. without contact), even if a pulse signal is supplied to the connection terminal 430 as the contact sense signal PS, the contact response signal RP remains at low level as depicted in FIG. 10 so a pulse signal will not appear. In this case, the contact sensing portion 523 will decide that the first sensor connection terminal 230 is not in contact with the connection terminal 430, or that the second sensor connection terminal 270 is not in contact with the connection terminal 470. The cartridge attachment check module M30 is notified of the result of the decision. In the event of a decision that the first sensor connection terminal 230 is not in contact with the connection terminal 430 or that the second sensor connection terminal 270 is not in contact with the connection terminal 470, on the assumption that the ink cartridge 100 has not been attached the main controller 40 of the printer 200 will carry out a process such as alerting the user to that effect.

According to the present invention described above, the printer 200 can sense the volume of ink in the ink cartridge 100 by supplying a liquid volume sense signal DS to the connection terminal 430; and can sense whether there is contact between the connection terminal 430 and the first sensor connection terminal 230 or whether there is contact between the connection terminal 470 and the second sensor connection terminal 270 by supplying the connection terminal 430 with a contact sense signal PS that is different from the liquid volume sense signal DS.

The liquid volume sense signal DS has maximum voltage of 36 V and minimum voltage of 4 V, whereas the contact sense signal PS is a pulse signal of VDD level (3.3 V), so the power consumption needed to deliver the contact sense signal PS will be much less than the power consumption needed to deliver the liquid volume sense signal DS. As a result, total power consumption by the printer 200 in the present embodiment can be reduced in comparison with the case where identical signals are used in both the contact sensing process and the liquid volume sensing process. Since the contact sensing process is executed periodically in short cycles at power-up, at the outset of printing, during printing etc., and since its frequency of execution is much higher than the liquid volume sensing process, the power consumption limiting effect will be appreciable. Also, by keeping the contact sense signal PS employed in the frequent contact sensing process to a low voltage level, the life of the sensor 110 can be prolonged.

Moreover, because the contact sense signal PS is a pulse signal of the power supply voltage VDD at which the logic (digital circuitry) of the sub-controller 50 operates, no analog circuit will be needed to generate the contact sense signal PS. Consequently, the number of components of the printer 200 can be reduced.

The driving signal generating circuit 42 which generates the liquid volume sensing signal DS is also employed to generate the driving signal that is used to drive the print head 5 during printing, and thus the liquid volume sensing process cannot be carried out during printing; however, the contact sense signal PS can be generated by the contact sensing portion 523 (which is a digital circuit) without using the driving signal generating circuit 42. Thus, the liquid volume sensing process can take place during printing as well.

Further, in the contact sensing process, in the event that the contact sensing portion 523 has sensed both a rising edge and a falling edge of the contact response signal RP, the contact sensing portion 523 decides that the first sensor connection terminal 230 is in contact with the connection terminal 430, and that the second sensor connection terminal 270 is in contact with the connection terminal 470, so sensing accuracy of contact sensing can be improved.

Additionally, in the contact sensing process, ground potential VSS is supplied to the connection terminal 470, and immediately after the state of the connection terminal 470 has switched from a state of being supplied with ground potential VSS to a high impedance state, a pulse signal is supplied to the connection terminal 430 as a contact sensing signal PS. Thus, contact sensing can be prevented from taking place while the connection terminal 470 is in an unstable condition due to wire capacitance or the like. As a result, sensing accuracy of contact sensing can be improved.

Further, the connection terminal 430 and the connection terminal 470 for carrying out contact sensing, as well as the corresponding first sensor connection terminal 230 and second sensor connection terminal 270, are positioned at the ends to either side of the terminal groups that connect the storage device 130 and the printer 200 (the connection terminal 210, the power supply terminal 220, the reset terminal 240, the clock terminal 250, the data terminal 260, and the connection terminals 410, 420, 440, 450, 460). As a result, contact between the terminals at both ends on the printer 200 side and the ink cartridge 100 side can be confirmed, so connection of printer 200 and ink cartridge 100 terminals situated between these will be assured.

D. Variations of Second Embodiment

Figure 20:
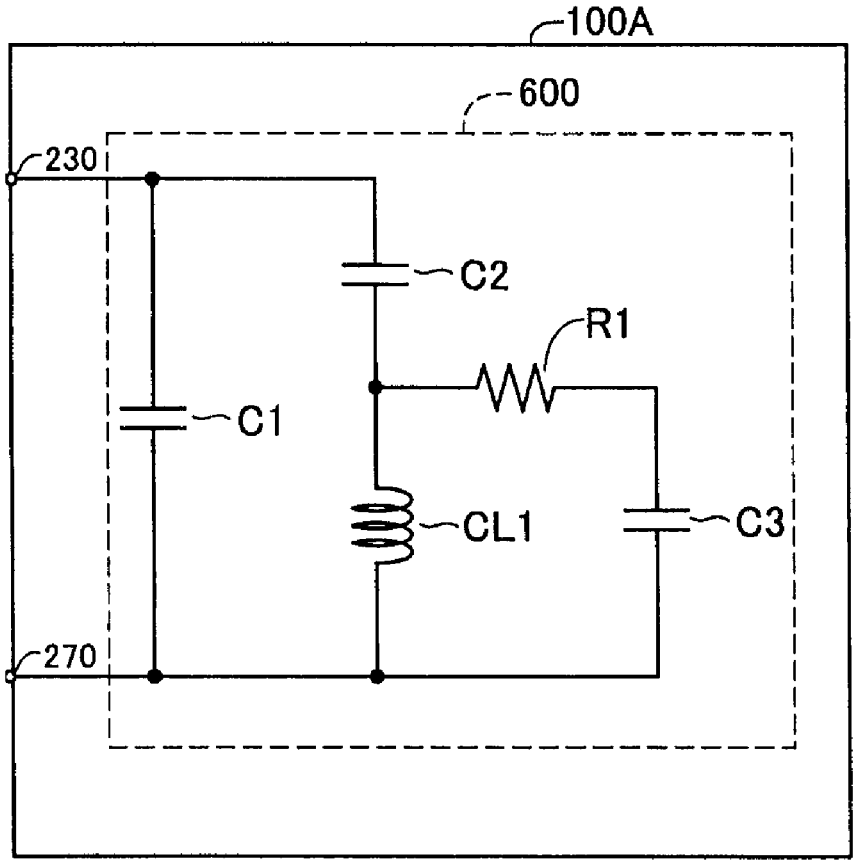
FIG. 20 is a diagram depicting an arrangement of an ink cartridge 100A in Variation 1.

Variation 1:

FIG. 20 is a diagram depicting an arrangement of an ink cartridge 100A in Variation 1. The ink cartridge 100A in Variation 1 includes a pseudo-circuit 600 in place of the sensor 110. Other arrangements are similar to the ink cartridge 100; these arrangements have been omitted from the illustration in FIG. 20.

The pseudo-circuit 600 includes capacitors C1, C2, C3, a resistor R1, and a coil CL1. The first capacitor C1 is connected at one end to the first sensor connection terminal 230, and at the other end to the second sensor connection terminal 270. The second capacitor C2 and the coil CL1 are connected in series. The series-connected second capacitor C2 and coil CL1 are connected at one end to the sensor connection terminal 230 and parallel to the first capacitor C1, and at the other end are connected to the second sensor connection terminal 270. The resistor R1 and the third capacitor C3 are connected in series. The series-connected resistor R1 and third capacitor C3 are connected in parallel to the coil C1.

In response to input of a liquid volume sense signal DS during the liquid volume sensing process, regardless of whether ink is actually present in the ink cartridge the pseudo-circuit 600 outputs a liquid volume response signal RS indicating that ink is present. Also, because the pseudo-circuit 600 is provided with the first capacitor C1 as a capacitive element, the pseudo-circuit 600 can output a contact response signal RP comparable to that in Second embodiment, in response to input of a contact sense signal PS during the contact sensing process. This kind of pseudo-circuit 600 would be used, for example, in ink cartridges for which the determination as to whether ink is present is left to the user.

Figure 21:
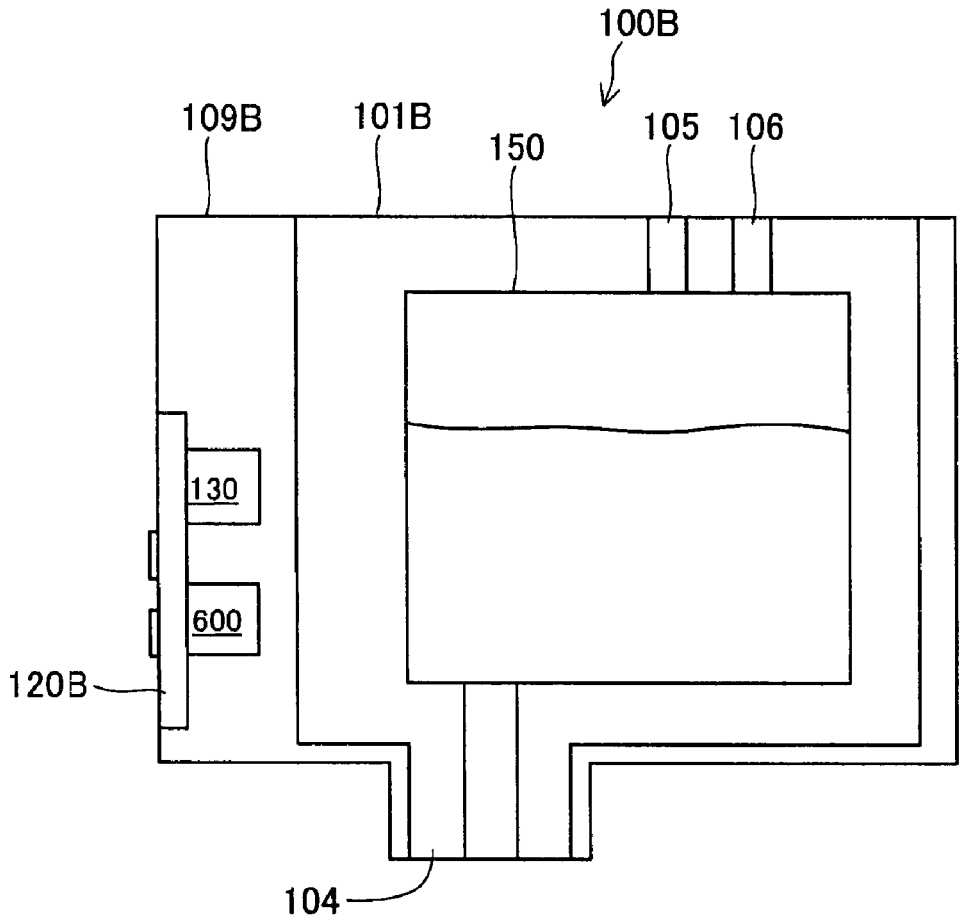
FIG. 21 is a first diagram illustrating an internal configuration of an ink cartridge furnished with the pseudo-circuit shown in Variation 1.
Figure 22:
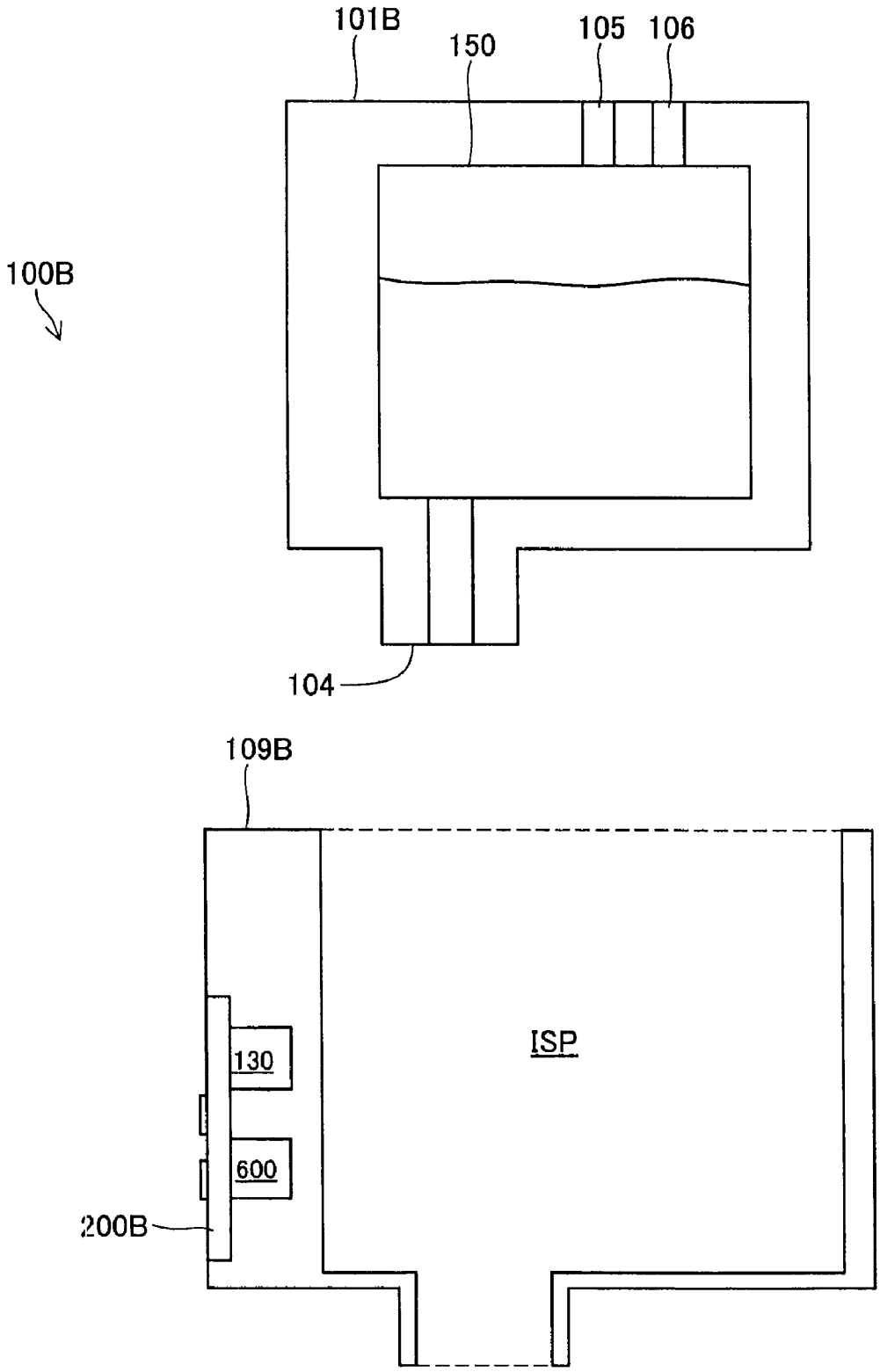
FIG. 22 is a first diagram illustrating an internal configuration of an ink cartridge furnished with the pseudo-circuit shown in Variation 1.

A pseudo-circuit 600 installation example will be described with reference to FIGS. 21 and 22. FIGS. 21 and 22 are diagrams illustrating an internal configuration of an ink cartridge furnished with the pseudo-circuit 600 shown in Variation 1. This ink cartridge 100B is provided with an ink containing portion 101B and an adapter 109B. The ink containing portion 101B is provided with an air intake hole 106, an ink chamber 150, and an ink delivery opening 104, as well as with a refill hole 105 that allows the ink chamber 150 to be refilled with ink after the ink has been consumed. As depicted in FIG. 22, the ink containing portion 101B and the adapter 109B can be manually separated by the user. For example, the user will detach the ink containing portion 101B from the adapter 109B, and after refilling the ink containing portion 101B will reinstall the ink containing portion 101B in the insertion space ISP of the adapter 101B. FIG. 21 depicts a condition in which the ink containing portion 101B has been installed in the insertion space ISP of the adapter 101B so that the adapter 109B and the ink containing portion 101B form an integrated unit. The adapter 109B will be installed in the holder 4 of the printer 200 in a manner comparable to the ink cartridge 100 of Second embodiment discussed previously. The pseudo-circuit 600 is mounted on the back face of a circuit board 120B. Detachment of the ink containing portion 109B from the adapter 101B and attachment of the ink containing portion 109B in the adapter 101B may take place with the adapter 109B left attached in the holder 4, or carried out with the adapter 109B detached from the holder 4.

Variation 2:

While the preceding embodiments described an example of an ink delivery system employing ink cartridges 100 for delivering ink to the printer 200, the present invention is not limited to ink cartridges 100 and may be implemented other ink delivery systems as well. For example, the present invention could be implemented in an ink delivery system that includes an ink tank for supplying ink to the ink delivery needle 6 of the printer 200 through a tube; and a circuit board (e.g. the circuit board 120B shown in Variation 1) that is attached to the holder 4 separately from the ink tank.

Variation 3:

In Second embodiment above, a single ink tank is constituted as a single ink cartridge, but it would be possible for a plurality of ink tanks to be constituted as a single ink cartridge.

Variation 4:

While an inkjet printer and ink cartridges are employed in Second embodiment above, it would also be acceptable to employ a liquid jetting apparatus adapted to jet or eject a liquid other than ink, and a liquid delivery system that delivers this liquid to the liquid jetting apparatus. Herein, the term liquid is used to include liquid-like bodies containing particles of a functional material dispersed in a medium; or fluid-like bodies of gel form. For example, there could be employed liquid jetting apparatuses adapted to jet a liquid that contains an electrode material, coloring matter, or other matter in dispersed or dissolved form, and used in the manufacture of color filters for liquid crystal displays, EL (electroluminescence) displays, or field emission displays; liquid jetting apparatuses adapted to jet bioorganic substances used in biochip manufacture; or liquid jetting apparatuses adapted to jet liquids as specimens used as precision pipettes. Additional examples are liquid jetting apparatuses for pinpoint jetting of lubricants into precision instruments such as clocks or cameras; liquid jetting apparatuses adapted to jet an ultraviolet-curing resin or other transparent resin solution onto a substrate for the purpose of forming a micro semi-spherical lens (optical lens) for use in optical communication elements etc.; or liquid jetting apparatuses adapted to jet an acid or alkali etchant solution for etching circuit boards, etc. The present invention can be implemented in any of the above types liquid jetting apparatus and liquid delivery system.

Variation 5:

Some of the arrangements that have been implemented through hardware in the preceding embodiments may instead be implemented through software, and conversely some of the arrangements that have been implemented through software may instead be implemented through hardware.

Variation 6:

In the preceding embodiments, the storage device 130 is employed as an electrical device installed in the ink cartridge 100, but the storage device 130 need not be provided. Where no storage device 130 is provided, there will be no need for a terminal group to connect the storage device 130 and the printer 200. Additionally, in place of the storage device 130, there could be employed other electrical devices, for example a CPU, ASIC or other processor adapted to exchange information with the sub-controller 50, or a simpler IC.

While the liquid container pertaining to the invention have been shown and described on the basis of the embodiment and variation, the embodiments of the invention described herein are merely intended to facilitate understanding of the invention, and implies no limitation thereof. Various modifications and improvements of the invention are possible without departing from the spirit and scope thereof as recited in the appended claims, and these will naturally be included as equivalents in the invention.

What is claimed is:

1. A liquid jetting apparatus adapted to receive delivery of liquid from a liquid delivery system, the liquid delivery system having a first delivery system-side terminal, the liquid jetting apparatus comprising:
- a first apparatus-side terminal adapted to contact the first delivery system-side terminal when the apparatus is receiving delivery of liquid from the liquid delivery system;
- a contact sensing portion adapted to supply a first electrical signal to the first apparatus-side terminal to sense contact between the first apparatus-side terminal and the first delivery system-side terminal; and
- a remaining level sensor portion adapted to supply a second electrical signal to the first apparatus-side terminal to sense a liquid volume in the liquid delivery system,
- wherein the second electrical signal is different from the first electrical signal, and
- the apparatus is adapted so that the power used by the apparatus to supply the first electrical signal is less than the power used by the apparatus to supply the second electrical signal.

2. The liquid jetting apparatus according to claim 1, wherein
- the contact sensing portion and the remaining level sensing portion are adapted such that a frequency of execution of sensing the contact is higher than a frequency of execution of sensing the liquid volume.

3. The liquid jetting apparatus according to claim 1, wherein
- the liquid jetting apparatus includes a digital controller adapted to control the power supply voltage of the first electrical signal at a voltage less than the voltage of the second electrical signal.

4. The liquid jetting apparatus according to claim 1 further comprising:
- a liquid jetting portion adapted to carry out jetting of the liquid responsive to a driving signal; and
- a driving signal generating circuit adapted to generate the driving signal,
- wherein the second electrical signal is generated by the driving signal generating circuit; and
- the first electrical signal is generated by a different circuit from the driving signal generating circuit.

5. A system comprising the liquid jetting apparatus according to claim 1 and a liquid delivery system wherein
- the liquid delivery system comprises:
  - a first delivery system-side terminal;
  - a second delivery system-side terminal; and
  - a capacitive element having a first electrode and a second electrode, the first electrode being connected to the first delivery system-side terminal and the second electrode being connected to the second delivery system-side terminal,
- and wherein the liquid jetting apparatus further comprises:
  - a second apparatus-side terminal adapted to contact the second delivery system-side terminal when receiving delivery of liquid from the liquid delivery system; and
- wherein the contact sensing portion is adapted to supply the first electrical signal to the first apparatus-side terminal, and is adapted to determine that there is contact between the first apparatus-side terminal and the first delivery system-side terminal and contact between the second apparatus-side terminal and the second delivery system-side terminal in response to receiving via the second apparatus-side terminal a first response electrical signal as a response to the first electrical signal.

6. The system according to claim 5, wherein
- the contact sensing portion is adapted to cause the first electrical signal to include a pulse signal having a rising edge and a falling edge;
- the contact sensing portion is adapted to cause the first response electrical signal to include a signal having a waveform substantially identical to the pulse signal; and
- the contact sensing portion is adapted to determine that there is contact between the first apparatus-side terminal and the first delivery system-side terminal and contact between the second apparatus-side terminal and the second delivery system-side terminal in response to sensing a rising edge and a falling edge of the first response electrical signal.

7. The system according to claim 6, wherein
- the contact sensing portion is adapted to supply a prescribed potential to the second apparatus-side terminal, then to separate the second apparatus-side terminal from the prescribed potential, and then to supply the first electrical signal to the first apparatus-side terminal.

8. The system according to claim 5, wherein
- the liquid delivery system further comprises:
  - a device different from the capacitive element, and
  - a third delivery system-side terminal connected to the device; and
- the liquid jetting apparatus further comprises:
  - a third apparatus-side terminal adapted to contact the third delivery system-side terminal when receiving delivery of liquid from the liquid delivery system, and wherein
- the third apparatus-side terminal is arranged between the first apparatus-side terminal and the second apparatus-side terminal.

9. The system according to claim 5, wherein the remaining level sensor portion is adapted to receive via the second apparatus-side terminal a second response electrical signal as a response to the second electrical signal, and is adapted to decide a liquid volume in the liquid delivery system based on the second response electrical signal.

10. The system according to claim 5, wherein
- the liquid delivery system includes a circuit board and a pseudo-circuit comprising the capacitive element,
- the pseudo-circuit is adapted to output a liquid volume response signal indicating that liquid is present in the liquid delivery system in response to receiving the second electrical signal via the first apparatus-side terminal, regardless of whether liquid is actually present in the liquid delivery system, and
- the first delivery system-side terminal, the second delivery system-side terminal and the capacitive element are disposed on the circuit board.

* * * * *